US010454214B1

(12) United States Patent
Sato

(10) Patent No.: US 10,454,214 B1
(45) Date of Patent: Oct. 22, 2019

(54) VEHICLE LIGHTING DEVICE AND METHOD

(71) Applicant: STANLEY ELECTRIC CO., LTD., Tokyo (JP)

(72) Inventor: Takashi Sato, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/183,636

(22) Filed: Nov. 7, 2018

(51) Int. Cl.

| | |
|---|---|
| ***H01R 13/639*** | (2006.01) |
| ***H01R 12/71*** | (2011.01) |
| ***H01R 13/631*** | (2006.01) |
| ***F21V 23/06*** | (2006.01) |
| ***H01R 43/26*** | (2006.01) |
| ***F21V 23/00*** | (2015.01) |
| ***H01R 13/627*** | (2006.01) |

(52) U.S. Cl.
CPC ..... *H01R 13/639* (2013.01); *F21V 23/001* (2013.01); *F21V 23/06* (2013.01); *H01R 12/716* (2013.01); *H01R 13/6271* (2013.01); *H01R 13/631* (2013.01); *H01R 43/26* (2013.01)

(58) Field of Classification Search
CPC ..... H01R 12/52; H01R 13/639
USPC ..... 439/78
See application file for complete search history.

(56) References Cited

U.S. PATENT DOCUMENTS 6,953,351 B2 * 10/2005 Fromm ..... H01R 13/514 439/101
8,057,259 B2 * 11/2011 Konno ..... H01R 13/64 439/607.35
10,094,993 B2 * 10/2018 Watanabe ..... G02B 6/3865
2009/0264022 A1 * 10/2009 Konno ..... H01R 13/64 439/675
2010/0304582 A1 * 12/2010 Vittapalli ..... H01R 12/727 439/65
2016/0380372 A1 * 12/2016 Hsieh ..... H01R 24/60 439/676
2017/0357062 A1 * 12/2017 Watanabe ..... G02B 6/3865
2017/0357065 A1 * 12/2017 Watanabe ..... G02B 6/3865

FOREIGN PATENT DOCUMENTS

| | | |
|---|---|---|
| JP | S61-161972 A | 7/1986 |
| JP | H10-255891 A | 9/1998 |
| JP | H10-321302 A | 12/1998 |

* cited by examiner

*Primary Examiner* — Tulsidas C Patel
*Assistant Examiner* — Peter G Leigh
(74) *Attorney, Agent, or Firm* — Kenealy Vaidya LLP

(57) ABSTRACT

A vehicle lighting assembly can include a fixed connector receptacle attached to a wiring board and configured for connection to a moveable connector plug and lock cover. The moveable connector plug has electrical wires extending from a rear end and can be inserted into the fixed connector receptacle. The lock cover can mate with both the fixed connector and the moveable connector plug to keep both structures in place after connection. The lock cover is configured to be rotatable around a front positioning portion of the lock cover when engaged in a positioning opening of the fixed connector receptacle. A rear positioning tab of the lock cover engages with a rear engagement aperture located on the moveable connector plug when in the fully assembled position to lock the moveable connector plug within the fixed connector receptacle.

22 Claims, 19 Drawing Sheets

VEHICLE LIGHTING DEVICE AND METHOD

BACKGROUND

The disclosed subject matter relates to electrical connection devices and assemblies, and particularly to electrical connection devices and assemblies for use in vehicular lighting applications where the connection is subject to a substantial amount of force, vibration, and temperature variance. Engine vibration and other forces, including forces transmitted from the vehicle suspension during travel of the vehicle cause a large amount stress on various connections throughout the vehicle, including electrical connections for the vehicle lighting systems located immediately adjacent suspension systems. Typically, electrical connectors include spring biased arms that mate with female receptacles to ensure positive and lasting connection between the structures, for example, between power cables/wires and a wiring board that controls or is part of a lighting circuit. These types of connectors sometimes loosen over time due to vibration and various force inputs. In addition, these connectors sometimes immediately fail due to improper installation when the male and female connection portions do not fully connect with each other to lock together. Conventionally, complicated and expensive male/female connection configurations, threaded connections, and other connectors have been used to ensure proper and long lasting connection at the time of manufacture. In addition, methods requiring manufacturers to push and pull the connectors a plurality of times after initial connection to test for and ensure proper connection have been used to prevent and/or detect failure of the connection structures. There has been a long felt need for more secure connection structures that are easily and quickly assembled, are low in cost, and provide definite and long lasting connection that withstands vehicle vibration as well as force and kinetic energy inputs to the vehicle, particularly inputs to/from the vehicle suspension.

SUMMARY

The related art is subject to various disadvantages, as noted above, including expensive, complicated connection structures that continue to be subject to manufacturing defects and failures, and that result in poor performing connection structures. For example, many typical fasteners become loose over time, or loosen due to a certain amount of force, vibration, or kinetic energy applied to the connection structure. Many connectors are also difficult to initially secure during manufacture, and immediately fail in the field, or require complicated testing and double checks during manufacture.

It may therefore be beneficial to provide a connection structure and method that addresses at least one of the above and/or other disadvantages of the related art. In particular, it may be beneficial to utilize a vehicle lighting assembly that includes a wiring board, a fixed connector receptacle mounted on the wiring board, a movable connector, and a lock cover. The fixed connector receptacle can include a plurality of terminals exposed from a front surface of the fixed connector receptacle, and connected to the wiring of the wiring board. Contact pins can be electrically connected to the plurality of terminals. A positioning opening can be located on an outer front surface of the fixed connector receptacle. The movable connector plug can include a connector body, electrical wires extending from a rear end of the connector body including an insulating material, a plurality of terminal attachment sections, and a plurality of lead wires having contact portions at their front ends located in each of the terminal attachment sections. The lead wires can be electrically connected to the electrical wires inside the connector body. A roof can project from a rear end portion of an upper surface of the movable connector plug. The roof can include two posts and a roof flex portion connecting the two posts. The roof flex portion can be configured to flex in an up-down direction. Body positioning projections can project upward from lateral rear ends of the upper surface of the connector body, while the top surfaces of the body positioning projections are flush with a top surface of the fixed connector receptacle, and a front end of the top surfaces and a front end of the roof flex portion is on a same line. The lock cover can include a front surface, a rear surface, and side surfaces each connecting the front surface and the rear surface, and an upper surface. A front positioning portion of the lock cover can project from the front surface of the lock cover toward the rear surface of the lock cover. A rear positioning tab can project from a rear surface of the lock cover to the front surface of the lock cover. When the movable connector plug is inserted into the fixed connector receptacle along an insertion direction, each of the contact pins is inserted into a corresponding terminal attachment section and makes electrical connection between respective contact portions and contact pins. An upper surface of the roof flex portion can be located inside of the body positioning projections, and the upper surface of the roof flex portion and the inner lower surface of the body positioning projections collectively define a rear engagement aperture, into which the rear positioning tab of the lock cover is engaged when in a fully assembled position. The upper surface of the roof flex portion can contact a lower surface of the rear positioning tab with flexible force of the roof flex portion, thereby lifting the rear positioning tab from below toward the body positioning projections to contact and retain the positioning tab adjacent the body positioning projections. A distance from an inner front surface to an inner rear surface of the lock cover is defined as distance A, a distance from an outer front surface of the fixed connector receptacle to a rear surface of the connector body when the rear surface of the connector body is in the fully assembled position is defined as distance B. In the fully assembled position, the connection between the contact pins and the contact portions is properly made in the plurality of terminal attachment sections, and distance A is equal to distance B. A distance from a front outer surface of the connector body to a front end of the roof is defined as distance C and corresponds to the distance from an inner front surface to a rear end of the fixed connector receptacle. A distance from a rear end of the roof to the rear end of the fixed connector receptacle is distance D. Only when distance D is within a predetermined range, distance B corresponds to (or is equal to) the sum of distance C and D, and the rear positioning tab can engage with the rear engagement aperture. The lock cover can be configured to be rotatable around the front positioning portion of the lock cover engaged in the positioning opening as a pivot along the side surfaces of the fixed connector receptacle, until the rear positioning tab engages with the rear engagement aperture in the fully assembled position. Some embodiments are directed to a vehicle lighting assembly that includes a wiring board, a fixed connector receptacle mounted on the wiring board, a movable connector plug, and a lock cover. The fixed connector receptacle can include a plurality of terminals exposed from a front surface of the fixed connector receptacle, and connected to the wiring of the wiring board. Contact pins can be electrically connected to the plurality of terminals. A positioning opening can be located on an outer front surface of the fixed connector receptacle. A receptacle positioning projection can be located on an inner upper surface of the fixed connector receptacle. The movable connector plug can be configured for insertion into the fixed connector receptacle and can include a connector body. The connector body can have an upper surface configured as an upward slope extending to a rear end of the connector body, and a positioning projection engaging with the receptacle positioning projection when in a fully assembled position, electrical wires extending from a rear end of the connector body, a plurality of terminal attachment sections, and a plurality of lead wires having contact portions at their front ends located in each of the terminal attachment sections. The lead wires can be electrically connected to the electrical wires. A roof projecting from a rear end portion of an upper surface can be provided on the movable connector plug. The roof can include a roof flex portion configured to be flexible in an up-down direction and defining a rear engagement aperture. An intermediate surface can be located under the upper surface and exposed at lateral rear ends of the connector body. A front end portion of the intermediate surface can be connected to a front end of the upper surface. Body positioning projections can project upward from lateral rear ends of the intermediate surface of the connector body, while outer top surfaces of the body positioning projections are flush with an outer top surface of the fixed connector receptacle. A retainer can be located in contact with a rear surface of the connector body, and can have an upper lateral extending portion. A rear engagement aperture can be defined by inner top surfaces of the body positioning projections and the intermediate surface of the connector plug. The lock cover can have a front surface, a rear surface, and side surfaces each connecting the front surface and the rear surface, and an upper surface. The lock cover can have a front positioning portion projecting from the front surface of the lock cover toward the rear surface of the lock cover, a rear positioning tab can project from a rear surface of the lock cover to the front surface of the lock cover. When the movable connector plug is inserted into the fixed connector receptacle along an insertion direction, each of the contact pins is inserted into a corresponding terminal attachment section and makes electrical connection between respective contact portions and contact pins. The rear positioning tab of the lock cover can be configured to engage the rear engagement aperture when in a fully assembled position. An upper surface of the roof flex portion can contact a lower surface of the rear positioning tab with flexible force of the roof flex portion, thereby lifting the rear positioning tab from below toward the body positioning projections to contact and retain the positioning tab adjacent the body positioning projections. The lock cover is configured to be rotatable around the front positioning portion of the lock cover engaged in the positioning opening as a pivot along the side surfaces of the fixed connector receptacle, until the rear positioning tab engages with the rear engagement aperture in the fully assembled position.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

Figure 1A:
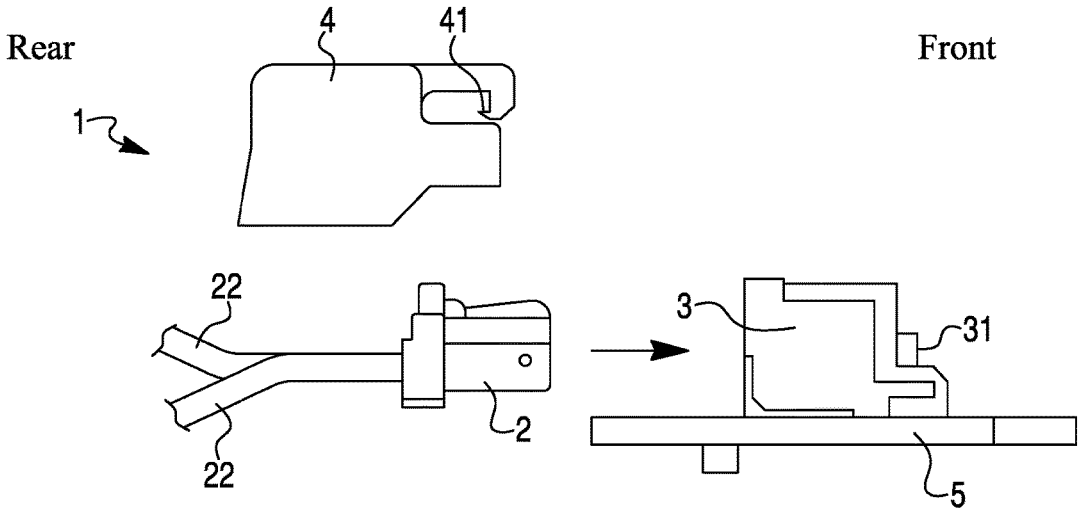
FIG. 1A is a side disassembled view of a vehicle lighting assembly made in accordance with principles of the presently disclosed subject matter.

FIG. 1A illustrates an embodiment of a vehicle light assembly 1 that includes a fixed connector receptacle 3 mounted onto a wiring board 5. A moveable connector plug 2 is shown approaching the fixed connector receptacle 3 for imminent connection thereto. A lock cover 4 is depicted above both the fixed connector receptacle 3 and moveable connector plug 2 in anticipation of being assembled over both structures to place the vehicle light assembly in a final assembled state.

Figure 1B:
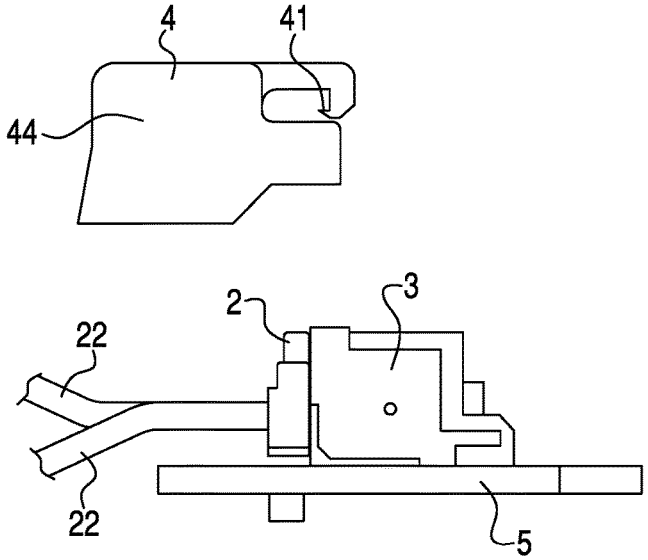
FIG. 1B is a side partially disassembled view of a vehicle lighting assembly of FIG. 1A.
Figure 4A:
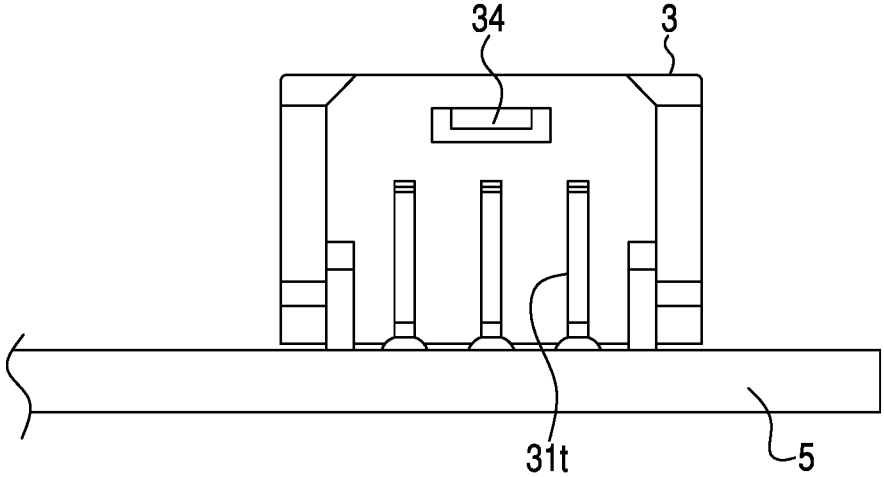
FIG. 4A is a front view of a fixed connector of a vehicle lighting assembly made in accordance with principles of the disclosed subject matter.
Figure 4B:
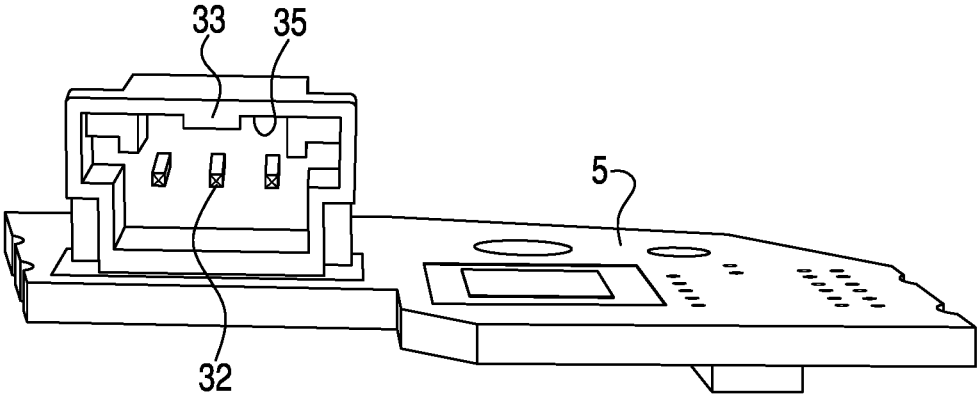
FIG. 4B is a rear perspective view of the fixed connector of FIG. 4A.
Figure 4C:
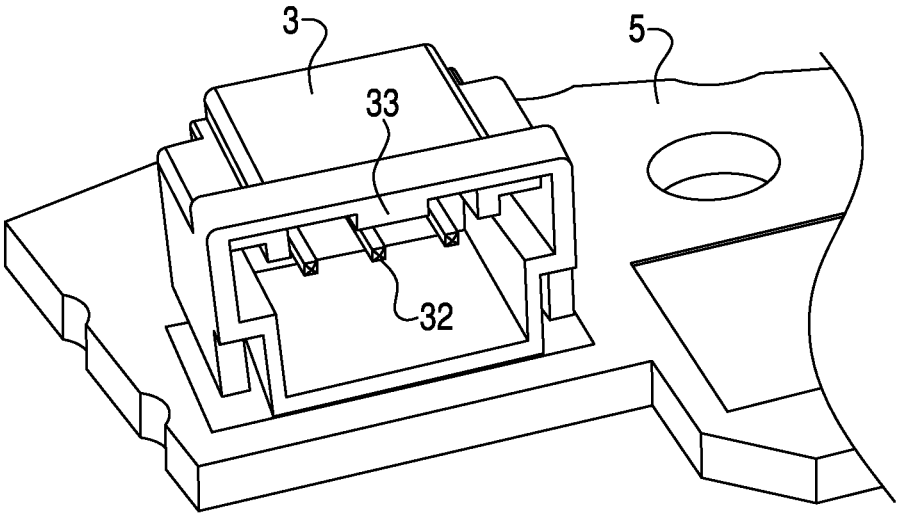
FIG. 4C is a top rear perspective view of the fixed connector of FIG. 4A.
Figure 4D:
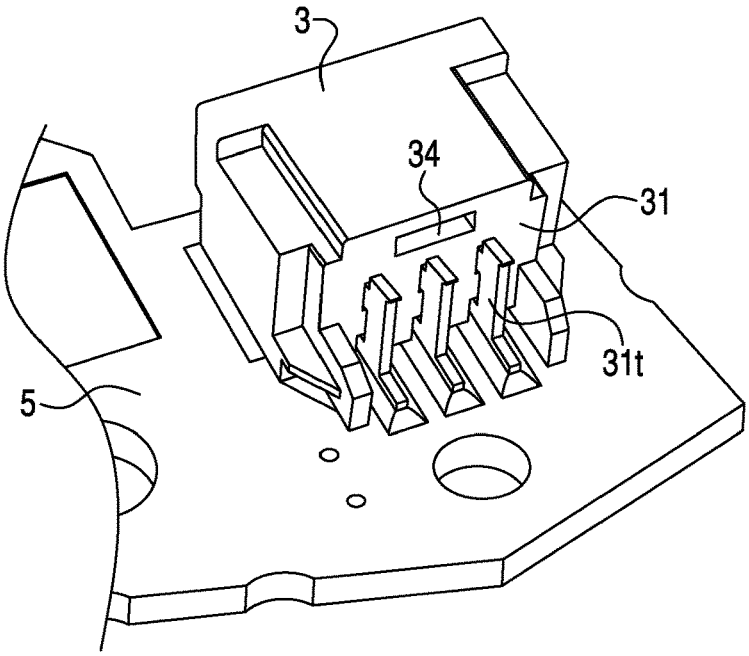
FIG. 4D is a top front perspective view of the fixed connector of FIG. 4A.

FIG. 1B shows the moveable connector plug 2 connected with the fixed connector receptacle 3 with the lock cover 4 still above and awaiting final assembly. In this semi-connected state, wires 22 extend from a rear of the moveable connector plug 2 and are electrically connected to the wiring board 5 via terminals 31*t* that extend from a front surface 31 of the fixed connector. The wires 22 connect to terminals 31*t* via lead wires 221 located in terminal attachment sections 23 (See FIG. 9) and contact pins 32 (See FIG. 4C) located in the fixed connector receptacle 3.

Figure 1C:
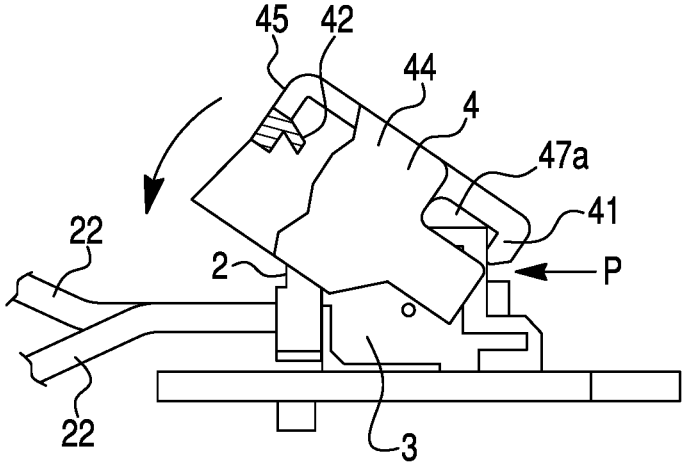
FIG. 1C is a side partially disassembled view of the vehicle lighting assembly of FIG. 1A.

FIG. 1C depicts one embodiment of a method for attaching the lock cover 4 to the assembled moveable connector plug 2 and fixed connector receptacle 3. Specifically, lock cover 4 can include a front positioning portion or tab 41 that mates with a positioning opening 34 of the fixed connector receptacle 3 to create a pivot point P for the lock cover 4. Once the tab 41 is in position in the positioning opening 34, the lock cover 4 can then be rotated about the pivot point P (in this figure, in a counterclockwise direction) and the lock cover 4 is thus placed over the pre-assembled moveable connector plug 2 and fixed connector receptacle 3.

Lateral openings 47*a*, 47*b* and rear aperture 45 can be provided in the lock cover 4 to allow a user to observe the rotation and subsequent connection of the lock cover 4 to the fixed connector receptacle 3. Specifically, aperture 45 allows a user to view a rear positioning tab 42 of the lock cover 4 as it mates with a mating lock structure (e.g., rear engagement space of the moveable connector plug 2—see FIG. 2C). Of course, the rear aperture 45 and lateral openings 47*a*, 47*b* also facilitate manufacture of the lock cover 4 such that the structure can be easily injection molded as a single piece structure, if desired.

Figure 1D:
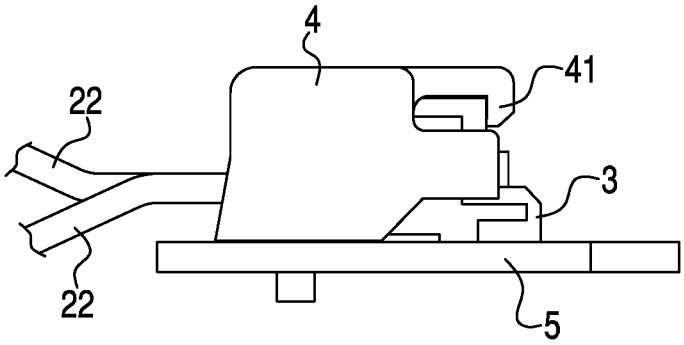
FIG. 1D is a side assembled view of the vehicle lighting assembly of FIG. 1A.

FIG. 1D shows the lock cover 4 in a fully assembled position over the fixed connector receptacle 3 and moveable connector plug 2.

Figure 2A:
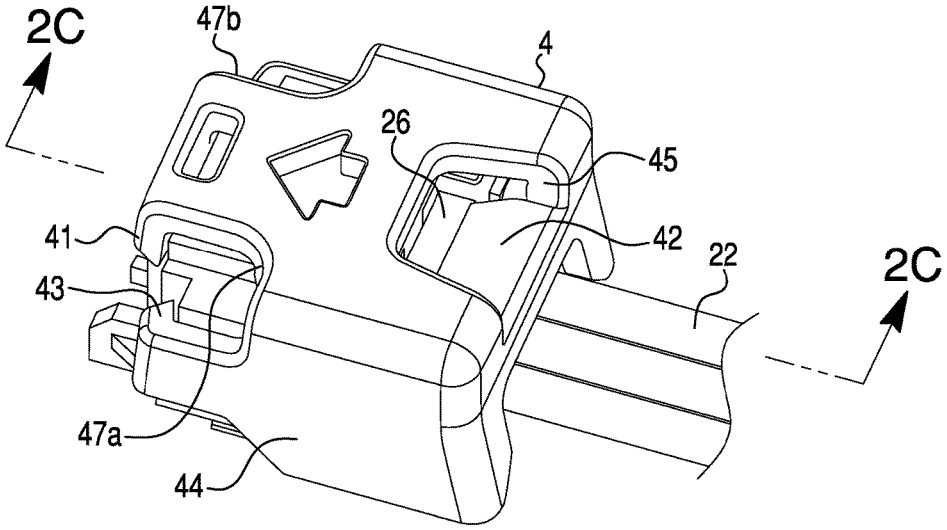
FIG. 2A is a top perspective view of another embodiment of a vehicle lighting assembly made in accordance with principles of the presently disclosed subject matter.

FIG. 2A is a rear perspective view of the fully assembled structures and, in this view, rear aperture 45 allows the connection between the rear positioning tab 42 and the roof structure 26 and body positioning projections 27 to be observable to ensure proper alignment and connection between the lock cover 4 and the pre-assembled fixed connector receptacle 3 and moveable connector plug 2. In particular, rear aperture 45 shows the tab 42 located on top of roof structure 26 and sandwiched between the roof structure 26 and body positioning projections 27 to secure the lock cover 4 over the connector plug 2 and connector receptacle 3.

Figure 2B:
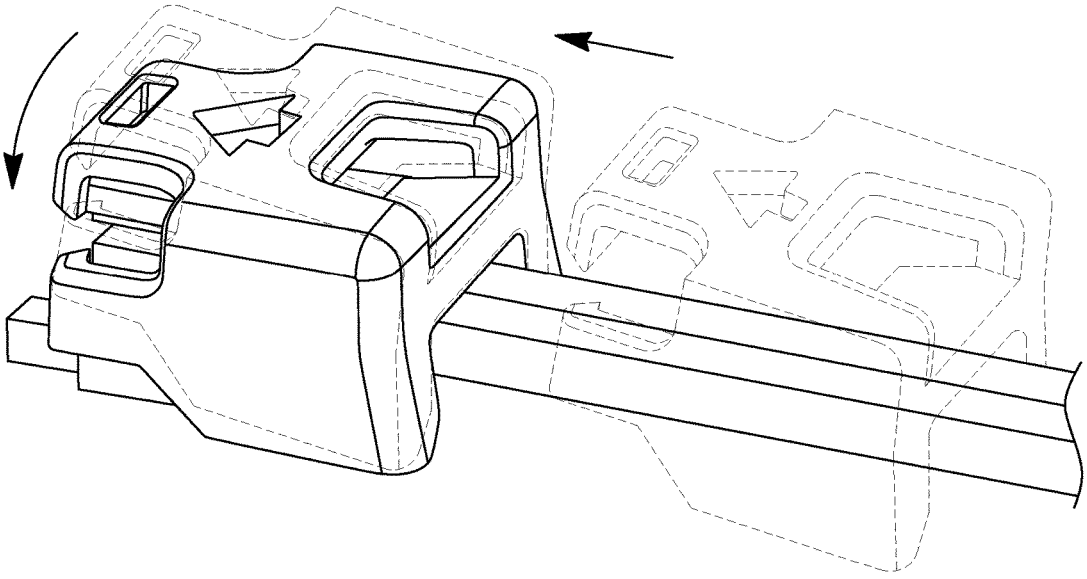
FIG. 2B is a top perspective view of the vehicle lighting assembly of FIG. 2A with phantom depiction of a method for using/connecting the assembly.

FIG. 2B depicts another embodiment of a method for connecting the lock cover 4 to the pre-assembled fixed connector receptacle 3 and moveable connector plug 2. In this case, the lock cover is slid along wires 22 and the rear positioning tab 42 is inserted into the aperture 29 between the roof structure 26 and the body positioning projections 27 of the moveable connector plug 2. Once the tab 42 is in place in the aperture 29, the entire lock cover can be rotated downwards towards the fixed connector receptacle 3 and moveable connector plug 2 until the front positioning portion or tab 41 clicks into the positioning opening 34 located on the front wall 31 of the fixed connector receptacle 3. Thus, the spring force of the front positioning portion 41 (acting in a rearward direction along a longitudinal axis of the wires 22) as well as the tab 42 (acting in a frontward direction opposed to the rearward direction) keep the lock cover 4 in place over the fixed connector receptacle 3 and moveable connector plug 2. The sides 44 of the lock cover 4 can be configured mate tightly with the outermost perimeter of the pre-assembled fixed connector receptacle 3 and moveable connector plug 2 to snuggly contain the structures within the lock cover 4. Apertures 47*a* and 47*b* can provide a window for the user to observe whether the fixed connector receptacle 3 and moveable connector plug 2 are properly aligned and connected together with the lock cover 4. In addition, positioning projections 43 located adjacent each of the apertures 47*a*, 47*b* can include hook like projections at distal ends that contact and springingly engage with the outermost perimeter of the fixed connector receptacle 3 to further ensure proper alignment and connection of the fixed connector receptacle 3, moveable connector plug 2, and lock cover 4.

Figure 2C:
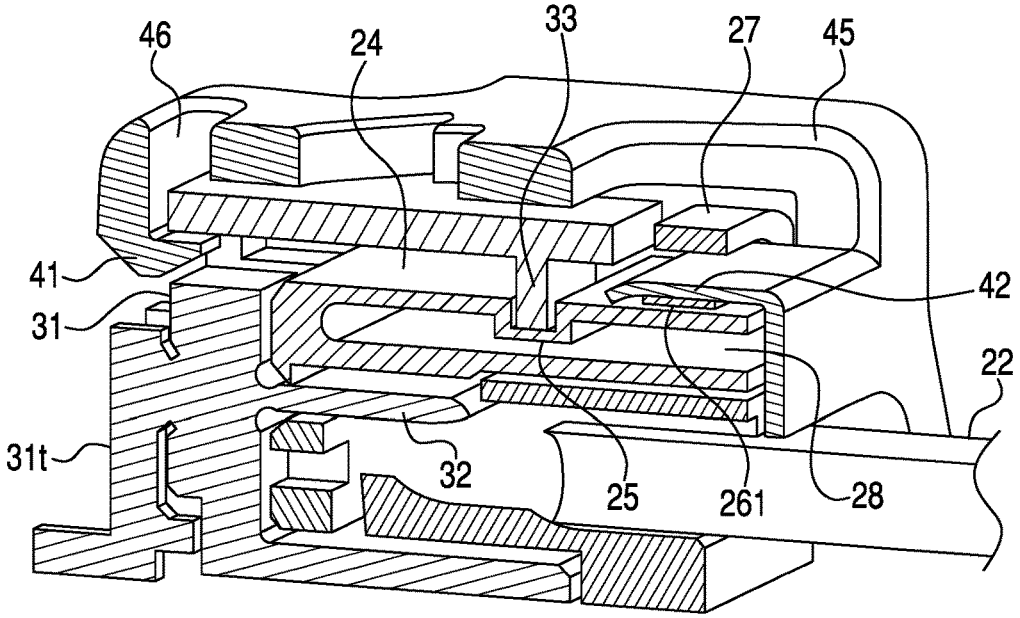
FIG. 2C is a cross section taken along line 2C-2C of FIG. 2A.

FIG. 2C is a cross-sectional view taken along line 2C-2C of FIG. 2A. The connection circuit path for the lighting assembly can be seen in this drawing, which runs from the wires 22 that have terminal attachment structures (see FIG. 9) that connect to contact pins 32 located within the fixed connector receptacle 3. The contact pins 32 can be connected to (or integrally formed with) the terminals 31*t* that extend from a front surface 31 of the fixed connector receptacle 3. The terminals 31*t* can be fixed to a wiring board 5 for electrical connection thereto via solder or other connection structures or materials. The cross section also allows a clear observation of the front and rear connection structures for the lock cover 4. In particular, front position portion or tab 41 is shown extending into positioning opening 34 (see FIG. 4A) of the fixed connector receptacle 3. In addition, rear positioning tab 42 is shown extending into rear engagement aperture 29 defined by the roof 26 and body positioning projections 27 of the moveable connector plug 2. The front aperture 46 and rear aperture 45 provide a window for observation of each of these connections. A receptacle positioning projection 33 can extend downward from an inner top surface of the fixed connector receptacle 3, and is configured to be seated in a mating positioning recess 25 located on an upper surface 24 of the moveable connector plug 2. The cross-sectional view of FIG. 2C also shows the roof reflex portion 261 of roof 26 contacting tab 42 and sandwiching the tab 42 between the roof 26 and body positioning projections 27. A lower surface of a front portion of the rear positioning tab 42 contacts at least a front portion of a top surface of the roof flex portion 261, and is retained from below by the roof reflex portion 261. An upper surface of a least a rear portion of the rear positioning tab 42 contacts inner surfaces of the body positioning projections 27. Therefore, the rear positioning tab 42 is secured in the rear engagement aperture 29.

Further, while in a front end portion of the movable connector plug 2, the upper surface 24 of the connector plug 2 is connected through a portion of a front side surface to an intermediate surface 28 to form a U shape. A rear end portion of the plug 2 includes an open end defined by a space between the upper surface 24 and the intermediate surface 28. Therefore, the rear end portion of the upper surface 24 is flexible in an up-down direction. This facilitates insertion movement of the rear positioning tab 42 into the rear positioning aperture 29 from a direction rearward of the plug 2, after rotating the rear positioning tab 42 with a pivot of the front positioning tab 41 engaged in the positioning opening 34.

Figure 3A:
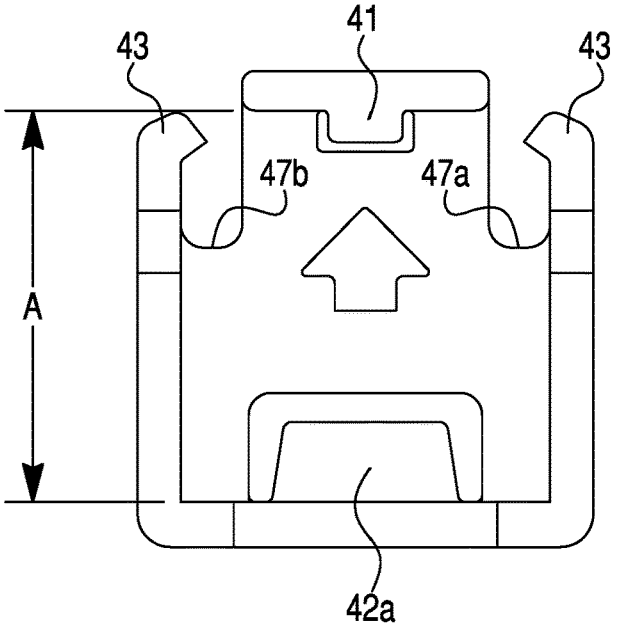
FIG. 3A is a bottom view of a lock cover of a vehicle lighting assembly made in accordance with principles of the disclosed subject matter.

FIG. 3A is a bottom view of the lock cover 4 and shows the front positioning portion or tab 41 as a projection extending from a front wall of the lock cover 4 in a rearward direction. The rear positioning tab 42 includes a lower surface 42*a*. In this view, it can be seen that the tab 41 and tab 42 are each completely "framed" within front aperture 46 and rear aperture 45, respectively. This configuration of the tabs 41, 42 and apertures 46, 45 not only allows for a clear view of the tabs 41, 42 by a user of the structure, but also facilitates separation of molding structures during manufacture, such as during injection molding manufacturing processes.

The lateral front side positioning projections 43 of the lock cover 4 are shown as arms extending frontward along each of the lateral sides 44 of the lock cover and forming a part of the border for each of the apertures 47*a*, 47*b*. The distal most portion of the lateral front side positioning projections 43 are cantered or angled inwardly to provide a type of lock tab that locks the lock cover 4 to the outermost periphery (e.g., the front surface 31) of the fixed connector receptacle 3. Thus, the side walls 44 prevent lateral movement of the lock cover with respect to the pre-assembled fixed connector receptacle 3 and moveable connector plug 2 while the front side positioning projections 43 (which are formed as flexible arm structures in the depicted embodiment) prevent longitudinal or front to rear movement of the pre-assembled fixed connector receptacle 3 and moveable connector plug 2. The rear positioning tab 42 and front positioning portion or tab 41 also prevent longitudinal or front to rear movement of the pre-assembled fixed connector receptacle 3 and moveable connector plug 2 while positively locking the lock cover 4 to the pre-assembled fixed connector receptacle 3 and moveable connector plug 2 (thus, also preventing vertical or upward movement of the lock cover 4 relative to the pre-assembled fixed connector receptacle 3 and moveable connector plug 2). The flexibility of the rear positioning tab 42 and front positioning portion or tab 41 cause a spring force to be exerted on the pre-assembled fixed connector receptacle 3 and moveable connector plug 2. In use, the lock cover 4 can be removed from the pre-assembled fixed connector receptacle 3 and moveable connector plug 2 by pulling upwards on the lock cover 4 with enough force to overcome the spring force of the rear positioning tab 42 located in the aperture 29 between the roof 261 and body positioning projections 27 of the moveable connector plug 2 (and/or to overcome the spring force of the front positioning portion or tab 41 located in the positioning opening 34 of the fixed connector receptacle 3).

The lock cover 4 is configured such that a distance "A" is defined as a linear distance from an inner surface of the rear wall 44*r* (from which the tab 42*a* extends inwardly and in a frontward direction) to an inner surface of the front wall 44*f* (from which the tab 41 extends inwardly and in a rearward direction).

Figure 3B:
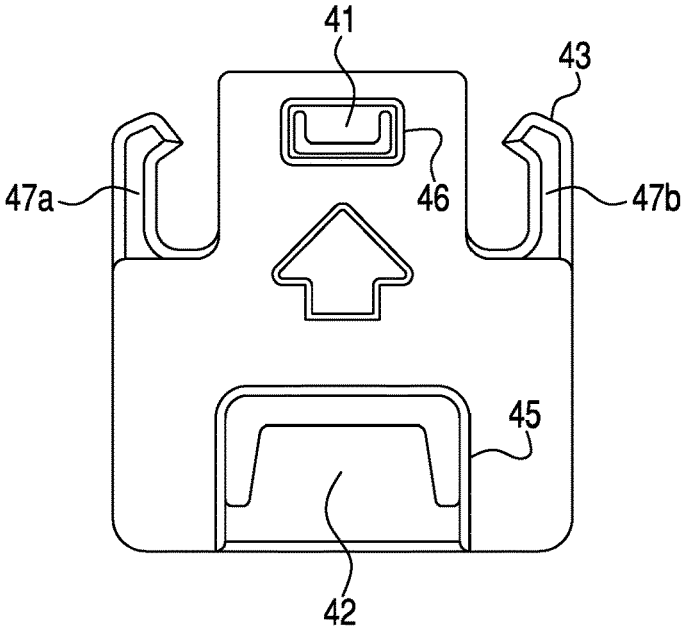
FIG. 3B is a top view of the lock cover of FIG. 3A.
Figure 3C:
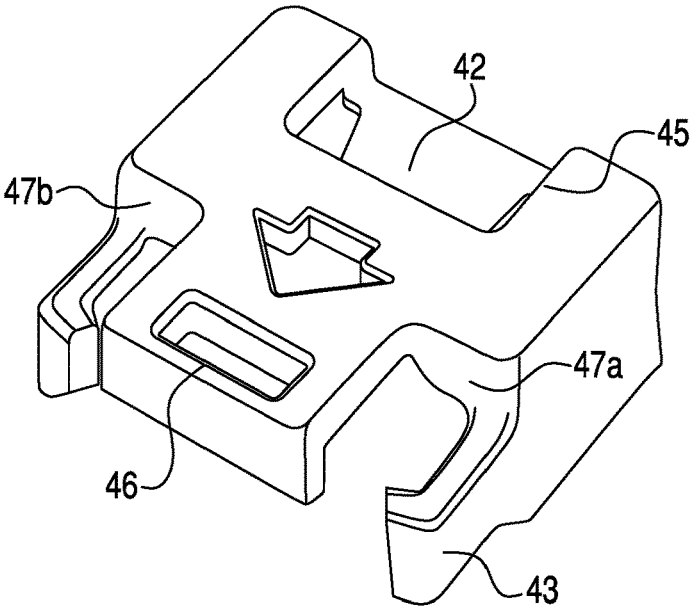
FIG. 3C is a top perspective view of the lock cover of FIG. 3A.
Figure 3D:
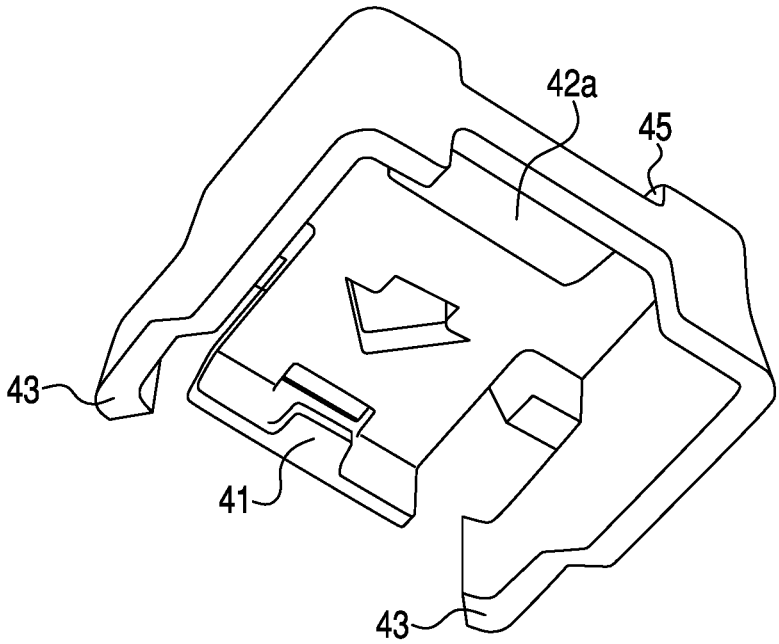
FIG. 3D is a bottom perspective view of the lock cover of FIG. 3A.

FIGS. 3B-3D show the lock cover 4 from a top view, and from front and rear perspective view, respectively. The front side positioning projections 43 are shown having a width in a vertical direction that is substantially less than the width of the wall of the lock cover 4. This allows the projections 43 to be formed as arm like structures that have a predetermined amount of flexibility suitable for exerting a spring force against the structure located between the arm-like projections 43 (e.g., against the fixed connector receptacle 3). This configuration also allows window apertures 47*a*, 47*b* to "wrap around" the top, front, and side surfaces of the lock cover 4 to provide substantial viewing areas for the user of the structure. The viewing areas allow the user to observe attachment of the lock cover 4 to the pre-assembled fixed connector receptacle 3 and moveable connector plug 2 to confirm correct alignment and connection.

FIGS. 4A-D show the fixed connector structure 3 attached to the wiring board 5. The fixed connector structure 3 can include a rectangular positioning opening 34 located at an upper portion of the front surface 31 of the fixed connector structure 3. The positioning opening 34 is configured to mate with the front positioning portion 41 of the lock cover 4 and can act as a pivot point if the lock cover is attached to the pre-assembled fixed connector receptacle 3 and moveable connector plug 2 from a front to rear direction (instead of the rear to front direction shown in FIG. 2B). Terminals 31*t* of the fixed connector receptacle 3 can extend from the front surface 31 of the fixed connector receptacle 3. The terminals 31*t* can be soldered or otherwise connected to a circuit such as a printed circuit located on the wiring board 5. The rear surface of the fixed connector receptacle 3 can include a large aperture 35 that mates with an outermost surface perimeter of the moveable connector plug 2 such that the moveable connector plug 2 is guided by walls that define the aperture 35 when the moveable connector plug 2 is slid into the aperture 35 in the fixed connector receptacle 3. Contact pins 32 extend from a rear surface of the aperture 35 and are configured to mate with terminal attachment sections 23 of the moveable connector plug 2. A receptacle positioning projection 33 can be located in a top surface of the aperture 35 of fixed connector receptacle 3 and is configured to contact with a mating positioning recess 25 located on a top surface of the moveable connector plug 2. The positioning projection 33 serves to keep the moveable connector plug 2 aligned with the fixed connector receptacle 3 during insertion of the moveable connector plug 2 into the aperture 35 of the fixed connector receptacle 3. The positioning projection 33 also provides a stabilizing force that keeps the moveable connector plug 2 aligned in the fixed connector receptacle 3 after pre-assembly, and ensures any force transmitted between these structures do not adversely affect (or transfer through) the contact pins 32.

Figure 5A:
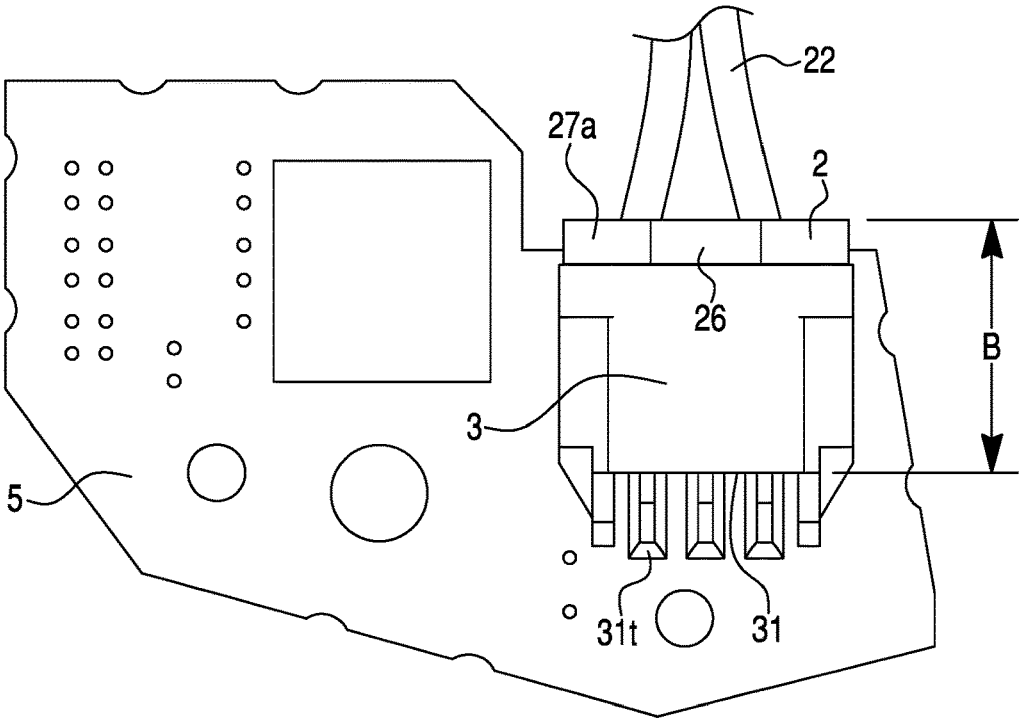
FIG. 5A is a top view of the moveable connector and fixed connector of the vehicle lighting assembly of FIG. 1.
Figure 5B:
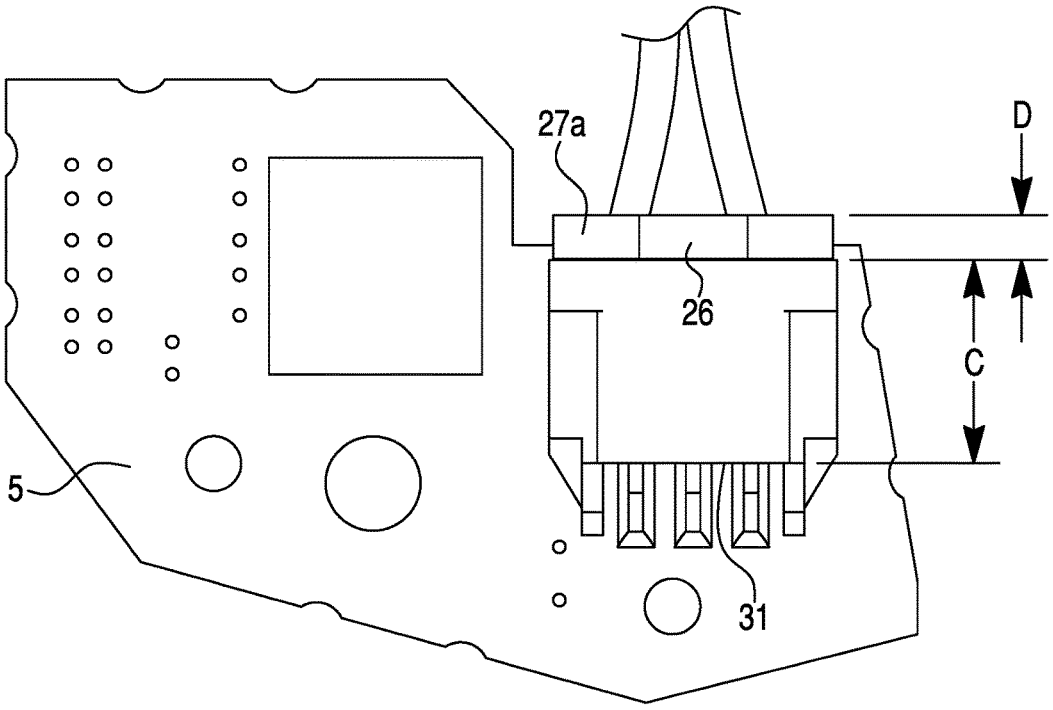
FIG. 5B is another top view of the moveable connector and fixed connector of the vehicle lighting assembly of FIG. 1.

FIG. 5A is a top view of the moveable connector plug 2 when pre-assembled into the aperture 35 of the fixed connector receptacle 3. A distance from the front surface 31 of the fixed connector receptacle 3 to a rear surface of the connector plug 2 is shown as distance "B" extending parallel with a front to rear (or longitudinal) direction of the lighting assembly 1. FIG. 5B shows the moveable connector plug 2 pre-assembled (i.e., fully inserted and connected to) the fixed connector receptacle 3. In this state, a distance from the front surface 31 of the fixed connector receptacle 3 to a rear surface of the fixed connector receptacle 3 is shown as distance "C", and a distance from a rear surface of a roof 26 (that defines a flexible archway—see FIG. 7C) to the rear surface of the fixed connector receptacle 3 is defined as distance "D". The distances are taken along a direction parallel with a front to rear (or longitudinal) direction of the lighting assembly. Thus, the distance "A" defined above with respect to the inner dimensions of lock cap 4 shown in FIG. 3A is equal to the sum of the distances "C" plus "D" shown in FIG. 5B.

Figure 6:
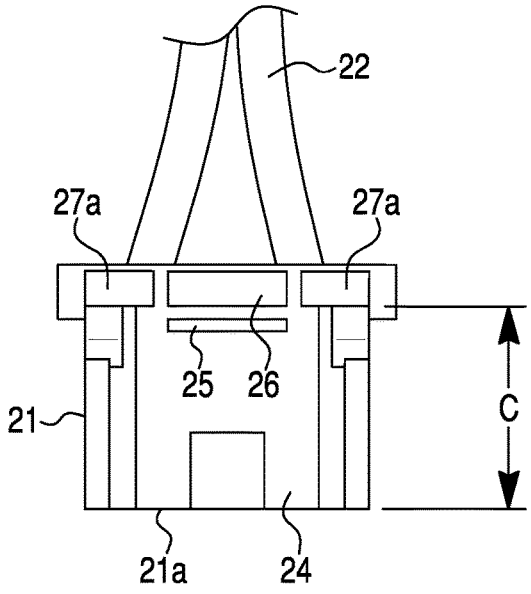
FIG. 6 is a top view of a moveable connector of a vehicle lighting assembly made in accordance with principles of the disclosed subject matter.

FIG. 6 is a top view of a moveable connector 2 for the assembly 1. A distance from a front outer surface 21*a* of the connector body 21 to a front end of the roof 26 is defined as distance "C" and corresponds to (or, is equal to) the distance from an inner front surface to a rear end of the fixed connector receptacle 3, as shown in FIG. 5B. The positioning recess 25 is clearly shown in this top view located just inside or below the roof 26 and extending into the plane of the drawing.

Figure 7A:
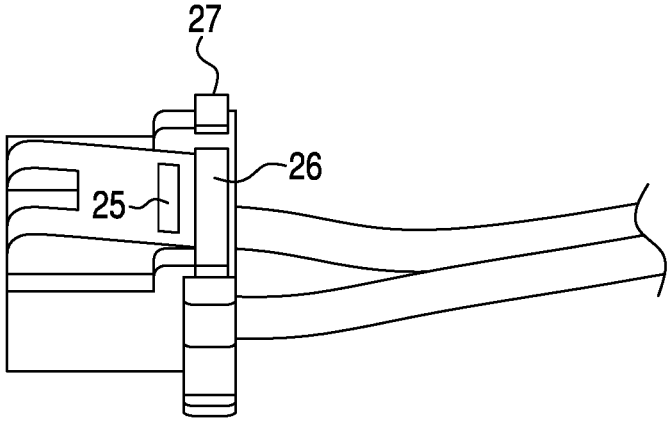
FIG. 7A is a side disassembled view of the moveable connector of FIG. 6.

FIG. 7A shows an embodiment of the moveable connector plug 2 with the wires 22 shown entering into the moveable connector plug 2. The moveable connector plug 2 can include positioning recess 25 configured to engage with the receptacle positioning projection 33 in the aperture 35 of the fixed connector receptacle 3 when assembled. Body positioning projections 27 can be provided adjacent the roof 26, and each project from lateral rear ends of the upper surface 24 of the moveable connector plug 2. Inner top surfaces of the body positioning projections 27 and a top surface of the roof 26 define a rear engagement aperture 29. The rear positioning tab 42 of the lock cover 4 is located in the rear engagement aperture 29 when in a fully assembled position. The body positioning projections 27 are also configured to direct or facilitate attachment movements of the rear positioning tab 42 into the rear engagement aperture 29 and thus secure connection therebetween.

Figure 7B:
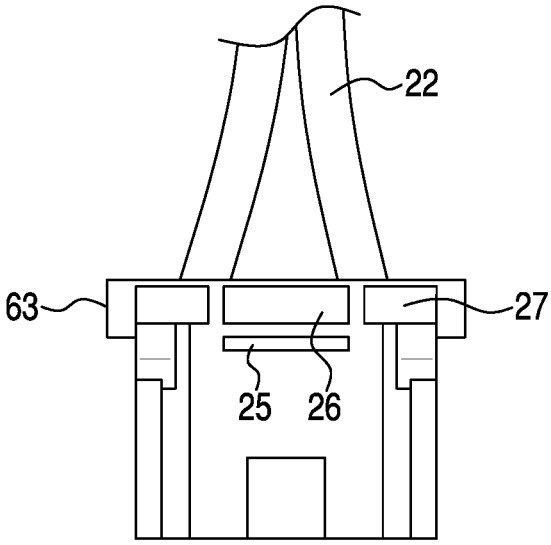
FIG. 7B is another top view of the moveable connector of FIG. 6.
Figure 7C:
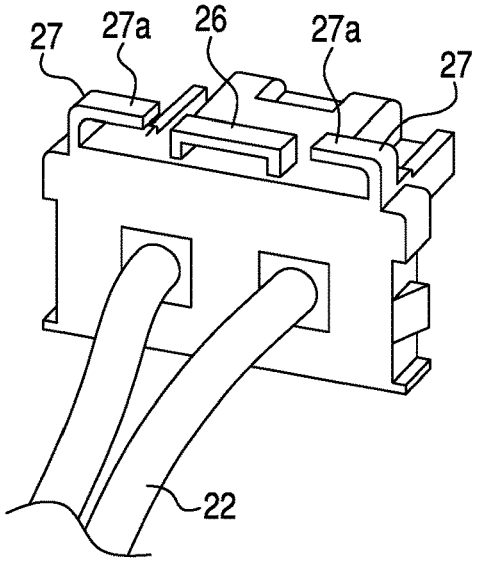
FIG. 7C is rear perspective view of the moveable connector of FIG. 6.

FIGS. 7B and 7C show the moveable connector plug 2 in a top and perspective view, respectively. In FIG. 7B, the rearmost edge and frontmost edges of the top surfaces 27*a* of projections 27 are respectively aligned with the rearmost edge and frontmost edge of the roof flex portion 261 of the roof 26.

Figure 8:
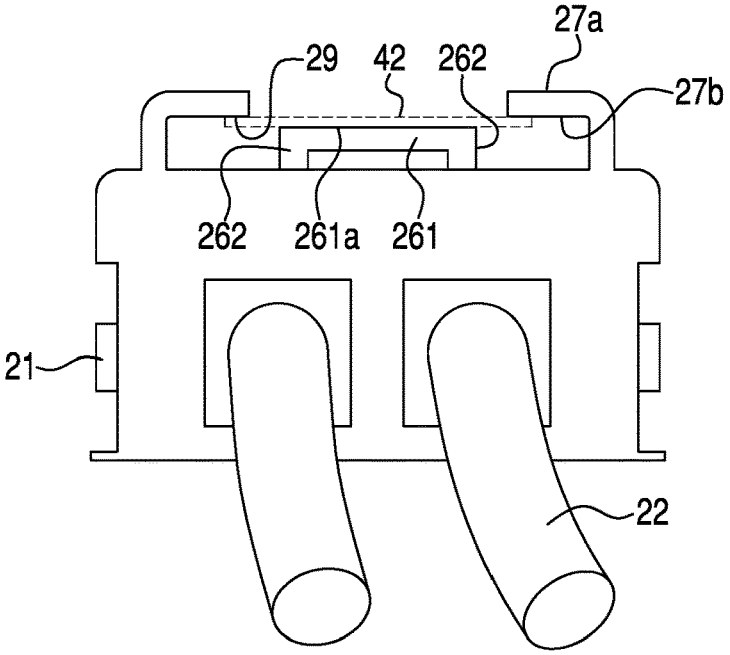
FIG. 8 is a rear view of the moveable connector of FIG. 6.

FIG. 8 shows a rear view of the moveable connector plug 2 in which the roof 26 is defined by a roof flex portion 261 that spans between two posts 262. The inner lower surface 27*b* of the body positioning projections 27 and the upper surface of roof flex portion 261 define part of the rear engagement aperture 29. During assembly, the rear positioning tab 42 will engage into the aperture 29 in order to lock the lock cover 4 with respect to the pre-assembled moveable connector plug 2 and fixed connector receptacle 3.

Figure 9:
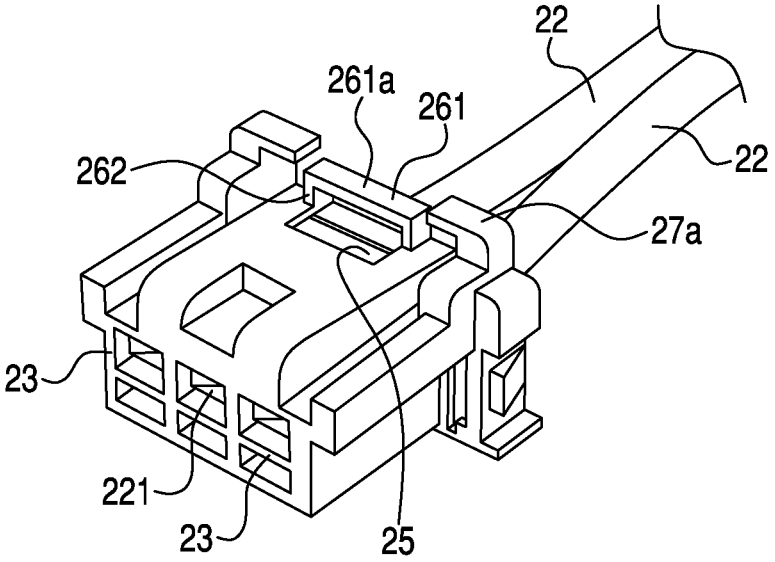
FIG. 9 is a front perspective view of the moveable connector of FIG. 6.

FIG. 9 is a front perspective view of the moveable connector plug 2. The roof 26 includes a roof flex portion 261 having an upper surface 261*a* located adjacent opposite surfaces of the upper surfaces 27*a* of each of the body positioning projections 27. Lead wire connectors 221 are located within terminal attachment sections 23 for connection to contact pins 32 of the fixed connector receptacle 3.

As noted above, the distance "A" is a distance from an inner front surface to an inner rear surface of the lock cover 4. A distance from an outer front surface of the fixed connector receptacle 31 to a rear surface of the connector 2 (connector body 21) when the rear surface of the connector body is in the fully assembled position is defined as distance "B". In the fully assembled position the connection between the contact pins 32 and the contact portions 221 of lead wires 22 is properly made in the plurality of terminal attachment sections 23. In this state, distance "A" can be equal to distance "B". As shown in FIG. 6, a distance from a front outer surface 21*a* of the connector body 21 to a front end of the roof 26 is defined as distance "C" and corresponds to the distance from an inner front surface to a rear end of the fixed connector receptacle 3. A distance from a rear end of the roof 26 to the rear end of the fixed connector receptacle 31 is considered distance "D". Only when distance "D" is within a predetermined range, can the rear positioning tab 42 of lock cover 4 engage with the rear engagement aperture 29 of moveable connector plug 2. The lock cover can be configured to be rotatable around the front positioning portion 41 of the lock cover 4 when engaged in the positioning opening 34 of the fixed connector receptacle 3. The positioning portion 41 will act as a pivot for the entire body of the lock cover 4 such that the lock cover will rotate until the rear positioning tab 42 engages with the rear engagement aperture 29 in the fully assembled position for the vehicle lighting assembly. Thus, the length and extension angles for the portions/tabs 41, 42 are selected in order to achieve a desired predetermined range for the distance D such that the lock cover 4 can be easily fitted to and locked to the pre-assembled moveable connector plug 2 and fixed connector receptacle 3. If the movable connector plug 2 is not properly pushed into its fully inserted position, electrical connection cannot be properly made between the lead wires 221 and contact pins 32, and the distance D exceeds the predetermined range. Thus, the sum of distances C and D does not correspond to (or is not equal to) the distance B in the fully assembled position, and then the rear positioning tab 42 of lock cover 4 cannot engage into the rear engagement aperture 29. On the other hand, only when the movable connector plug 2 is in its fully inserted position in which the electrical connection is properly made, the distance D falls within the predetermined range and the sum of distance C and distance D corresponds to (or is equal to) the distance B in the fully assembled position, then the rear positioning tab 42 of lock cover 4 can engage into the rear engagement aperture 29. In addition, the distance D can be selected such that a predetermined amount of force can cause the lock cover 4 to be removed from the pre-assembled fixed connector receptacle 3 and moveable connector plug 2. In other words, the removal force is within an elastic range of deformation of the tabs 41, 42 and roof 26 such that the assembly structures can be re-used after the lock cover 4 is forceably removed from the pre-assembled fixed connector receptacle 3 and moveable connector plug 2. Of course, in another embodiment, if a retainer 6 is used, the distance E, or the distance D plus E (see FIG. 12B) can be selected such that a predetermined amount of force can cause the lock cover 4 to be removed from the pre-assembled fixed connector receptacle 3 and moveable connector plug 2.

FIGS. 10A to 16 show a second exemplary embodiment of the vehicle light assembly based upon the presently disclosed subject matter. In the description of each exemplary embodiment, the same reference numerals are given to the same or corresponding elements, and redundant descriptions will be omitted properly. The second exemplary embodiment is different from the first embodiment in FIGS. 1 to 9 in that the second exemplary embodiment uses a body attachment projection 241 instead of the mating positioning recess 25 for engaging the movable connector plug 2 to the fixed connector receptacle 3, and incorporates a retainer 6 to push up the rear positioning tab 42 from below and retain the tab 42 to contact with the body positioning projections 27 while the roof 26 is omitted. Further, the body positioning projections 27 project from lateral ends of an intermediate surface 28. In the second exemplary embodiment, the upper surface 24 is flexible and extends to form an upward slope to the rear end of the movable connector plug 2. While in a front end portion of the movable connector plug 2, the upper surface 24 of the connector plug 2 is connected through a portion of a front side surface to an intermediate surface 28 to form a shape similar to a modified letter "U", a rear end portion of the plug 2 is an open end, and there is a space between the upper surface 24 and the intermediate surface 28. The upper surface 24 has a longitudinal length which is sufficient to push up from below and retain the receptacle positioning projection 33 of the receptacle 3, and may not extend to the rear end of the movable connector plug 2. In top view of the movable connector plug 2, the intermediate surface 28 is exposed (See FIG. 11). Beneath the intermediate surface 28, terminal attachment sections 23 are formed. The intermediate surface 28 forms part of contour portions of the terminal attachment sections 23. The second exemplary embodiment is explained in more detail below.

FIG. 10A to 10D show a method for attaching the lock cover 4 to the assembled moveable connector plug 2 with retainer 6 and fixed connector receptacle 3. The second exemplary embodiment is different from the first one in a pre-assembled state into the aperture 35 of the fixed connector receptacle 3. In this view, it should be noted that a retainer 6 is connected to a rear end of the moveable connector plug 2 and can form a part of the moveable connector plug 2. The retainer 6 can be used to secure and/or guide the wires 22 within the moveable connector plug 2.

Figure 10A:
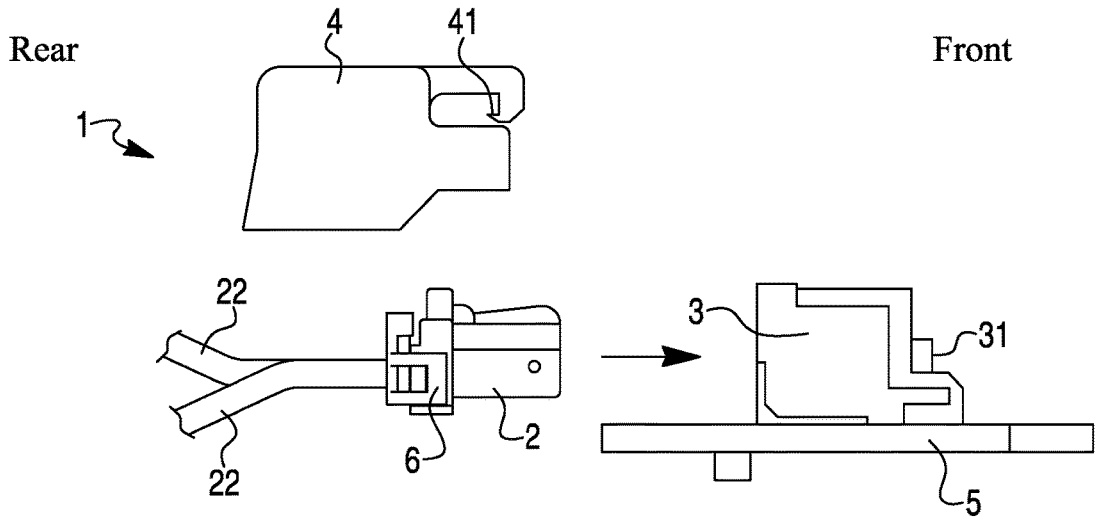
FIG. 10A is a side disassembled view of another exemplary embodiment of a vehicle lighting assembly made in accordance with principles of the presently disclosed subject matter.

As shown in FIG. 10A, the second exemplary embodiment of the vehicle light assembly 1 includes a retainer 6 configured to clip onto a rear of the plug 2. The retainer 6 can provide spacing dimensions for snug connection to the lock cover 4 when the lock cover 4 is in place on the fixed connector receptacle 3. In addition, in some applications, the retainer 6 can provide a more secure and longer lasting connection of the wires 22 to the plug 2.

Figure 10B:
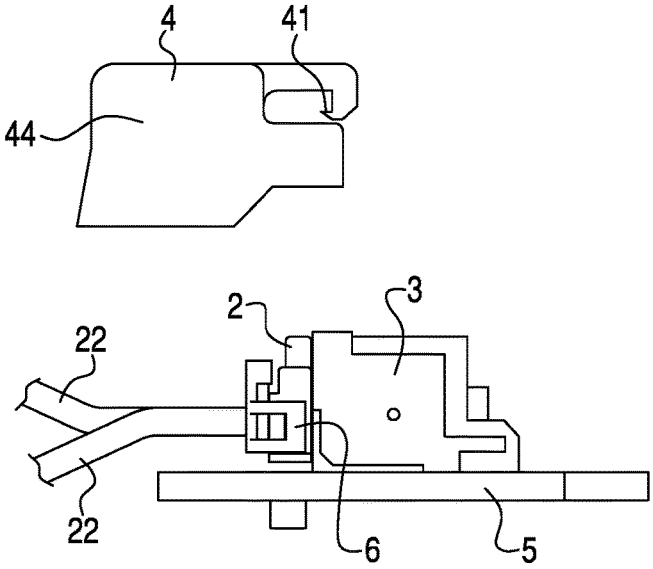
FIG. 10B is a side partially disassembled view of a vehicle lighting assembly of FIG. 10A.

FIG. 10B depicts the moveable connector plug 2 and retainer 6 of FIG. 10A connected with the fixed connector receptacle 3. The lock cover 4 remains above and awaiting final assembly with the plug 2 and connector receptacle 3.

Figure 10C:
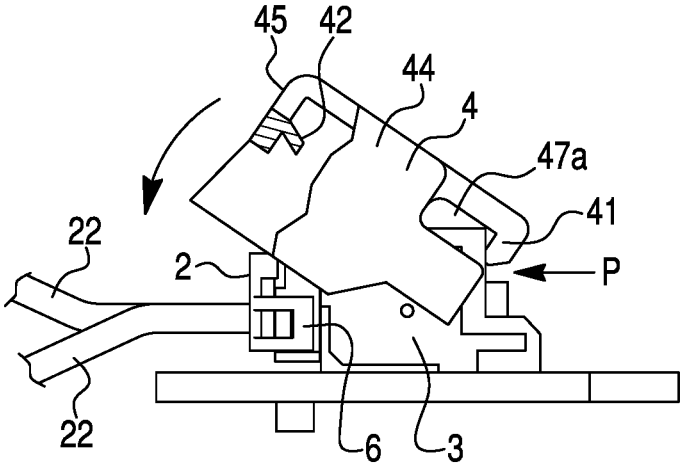
FIG. 10C is a side partially disassembled view of the vehicle lighting assembly of FIG. 10A.

FIG. 10C depicts an embodiment of a method for attaching the lock cover 4 to the assembled moveable connector plug 2 with retainer 6 and fixed connector receptacle 3. The method can be substantially similar to the method described above with respect to FIG. 1C. However, the retainer 6 can be configured to provide a cushion or snug fit when the lock cover 4 is connected to and rotated onto the fixed connector receptacle 3, allowing for machining or manufacturing tolerances of various parts of the assembly 1.

Figure 10D:
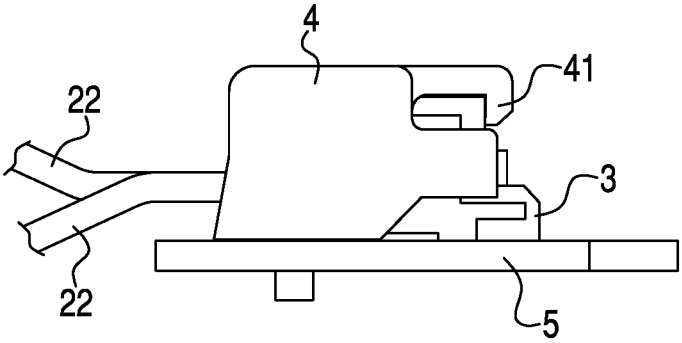
FIG. 10D is a side assembled view of the vehicle lighting assembly of FIG. 10A.

FIG. 10D shows the lock cover 4 of the embodiment of FIG. 10A in a fully assembled position over the fixed connector receptacle 3, moveable connector plug 2, and retainer 6 (obstructed in this view).

Figure 11:
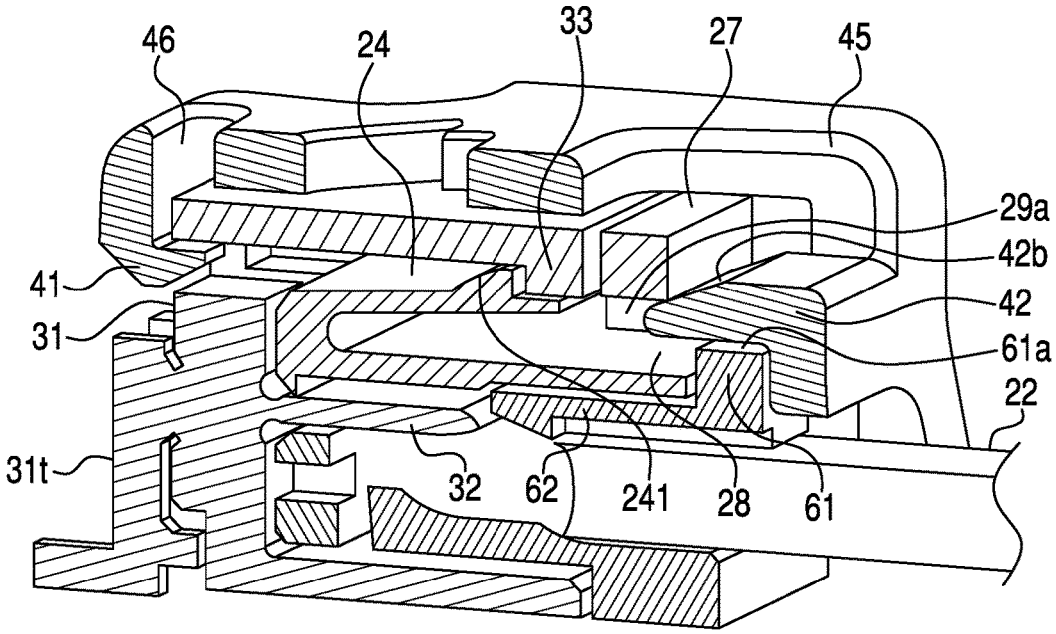
FIG. 11 is a cross section of the lighting assembly of FIG. 10A.

FIG. 11 is a similar cross section as compared to the cross section shown in FIG. 2C but taken of the second embodiment of the assembly 1 shown in FIG. 10A. In this embodiment, retainer 6 is shown adjacent a rear surface of the connector plug 2. In addition, a body attachment projection 241 extends upward from a top surface of the connector plug 2 to mate with the receptacle positioning projection 33 of the receptacle 3. The portion of the connector plug 2 that extends to the projection 241 can be ramped upward to act as a spring such that the attachment projection 241 is constantly forced upward against the receptacle positioning projection 33. The rear positioning tab 42 snugly fits into a gap or space 29*a* defined by the body positioning projections 27 and the intermediate surface 28 of the connector plug 2. Retainer 6 includes an upper lateral extending portion 61 (where the reference line 6 contacts retainer 6 in FIG. 11). The upper lateral extending portion 61 includes a top surface 61*a* which contacts with a rear surface of the rear positioning tab 42 such that the portion 61 pushes up on the positioning tab 42 to hold the tab 42 against the body positioning projections 27 (similar to the way that roof flex portion 261 exerts an upward force against tab 42 in the embodiment of FIG. 2C).

Figure 12A:
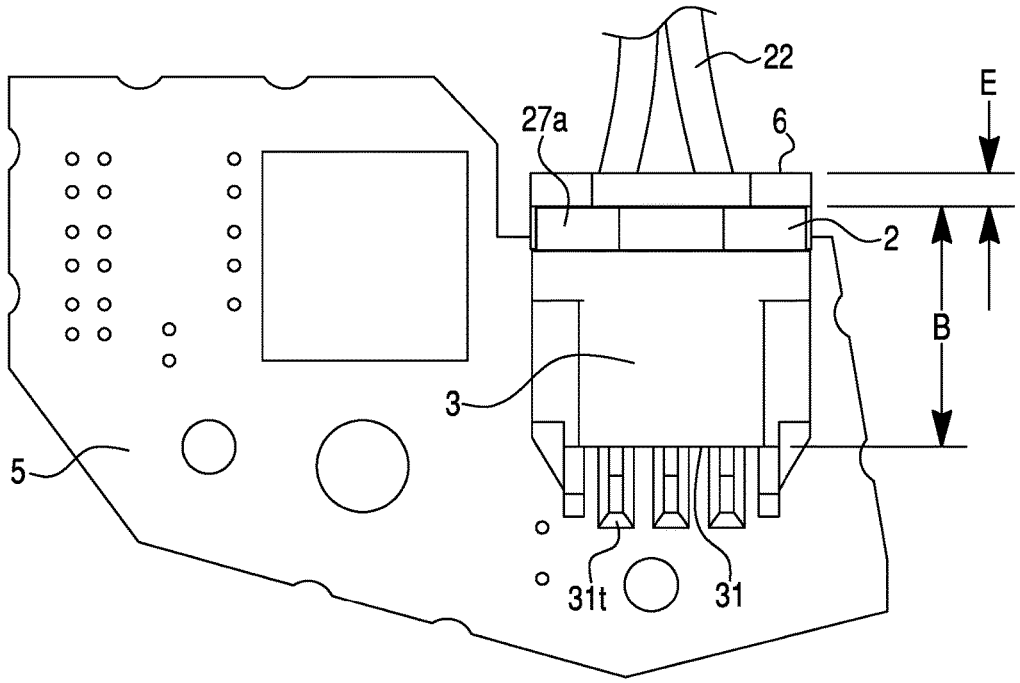
FIG. 12A is a top view of the moveable connector and fixed connector of the vehicle lighting assembly of FIG. 10A.

FIG. 12A is a top view of the moveable connector plug 2 of the embodiment shown in FIG. 10A, when pre-assembled into the aperture 35 of the fixed connector receptacle 3. In this view, it should be noted that a retainer 6 is connected to a rear surface of the moveable connector plug 2 and can form a part of the moveable connector plug 2 in this embodiment. The retainer 6 can be used to secure and/or guide the wires 22 within the moveable connector plug 2. The retainer 6 is shown abutting a rear surface of the connector plug 2. A thickness of the retainer 6 as viewed from the top view (as shown in FIG. 12A) is a distance "E". Thus, a distance from the front surface 31 of the fixed connector receptacle 3 to a rear surface of the retainer 6 is shown as distance "B" plus distance "E" extending parallel with a front to rear (or longitudinal) direction of the lighting assembly 1. The distance "A" defined above with respect to the inner dimensions of the lock cover 4 shown in FIG. 3A is equal to the sum of the distances "B" plus "E" shown in FIG. 12A. The retainer 6 can be clipped onto the connector plug 2 to provide the requisite structural length such that the lock cover 4 can fit snugly over the connector plug 2 with retainer 6 when the connector plug 2 is fully inserted in the fixed connector 3. Thus, different sized retainers 6 can be provided to correct for manufacturing tolerances of the connector plug 2 and/or fixed connector 3. Further, the retainer 6 can be made of a material that is more elastic and therefore allows greater tolerance of manufacture for the various parts while allowing for a snug fit of the lock cover 4 over the assembled connector plug 2 and fixed connector 3.

Figure 12B:
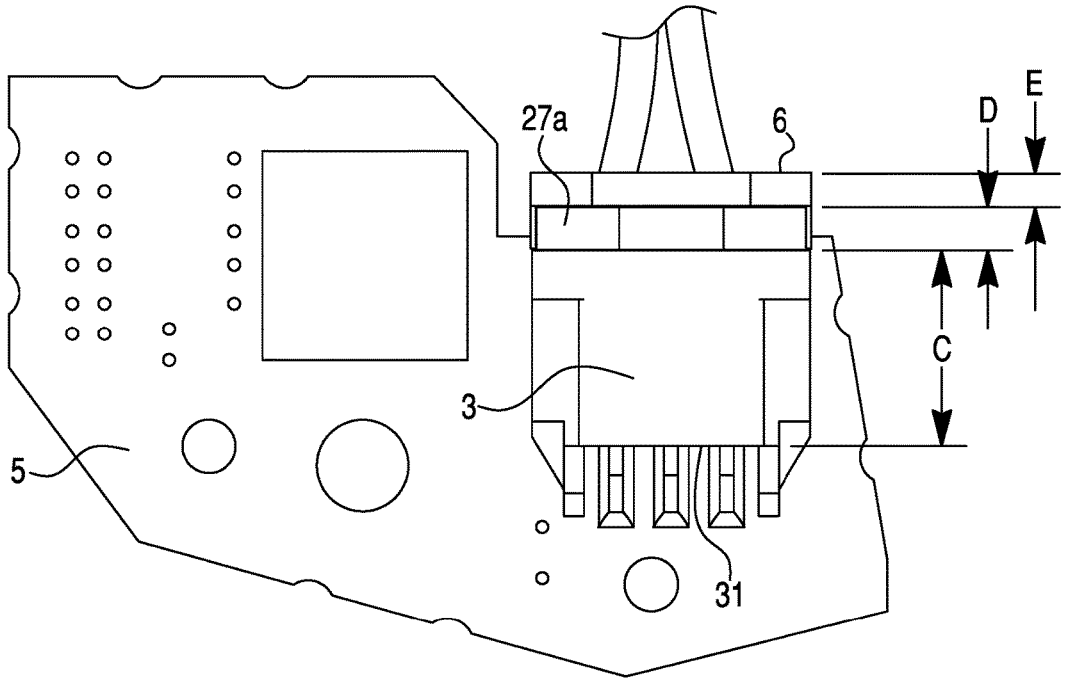
FIG. 12B is another top view of the moveable connector and fixed connector of the vehicle lighting assembly of FIG. 10A.
Figure 13:
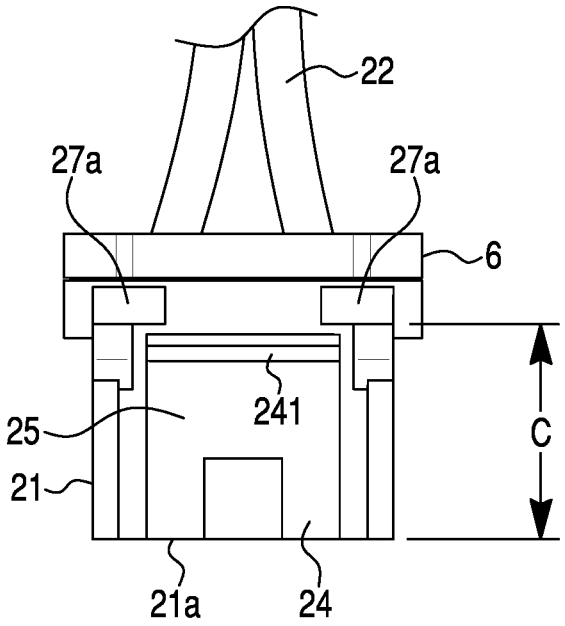
FIG. 13 is a top view of another exemplary embodiment of a moveable connector of a vehicle lighting assembly made in accordance with principles of the disclosed subject matter.

FIG. 12B shows the moveable connector plug 2 of the embodiment depicted in FIG. 10A pre-assembled (i.e., fully inserted and connected to) the fixed connector receptacle 3. In this state, a distance from the front surface 31 of the fixed connector receptacle 3 to a rear surface of the fixed connector receptacle 3 is shown as distance "C", and a distance from a rear surface of a roof 26 to the rear surface of the fixed connector receptacle 3 is defined as distance "D", while a distance "E" is the thickness, length from a font to rear end of an upper lateral extending portion 61 of the retainer 6. The distance "A" defined above with respect to the inner dimensions of the lock cover 4 shown in FIG. 3A is equal to the sum of the distances "C" plus "D" plus "E" shown in FIG. 12B. The distances are taken along a direction parallel with a front to rear (or longitudinal) direction of the lighting assembly. If the movable connector plug 2 is not properly pushed into its fully inserted position, electrical connection cannot be properly made between the lead wires 221 and contact pins 32, and the distance D exceeds the predetermined range, the sum of distances C plus D plus E does not correspond to (or is not equal to) the distance A (distance B plus E) in the fully assembled position, then the rear positioning tab 42 of lock cover 4 cannot engage into the rear engagement aperture 29. Only when sum of the distance D and distance E is within a predetermined range, the sum of distances C plus D plus E corresponds to (or is equal to) the distance A (distance B plus E) in the fully assembled position, the rear positioning tab (42) can engage with the rear engagement aperture (29). FIG. 13, is a top view of a moveable connector 2 according to the embodiment shown in FIG. 10A for the assembly 1. A distance from a front outer surface 21*a* of the connector body 21 to a front end of the top surfaces 27*a* of projections 27 is defined as distance "C" and corresponds to (or, is equal to) the distance from an inner front surface to a rear end surface of the fixed connector receptacle 3, as shown in FIG. 12B. In this embodiment, body attachment projection 241 is shown extending out of the plane of the drawing towards a viewer.

Figure 14A:
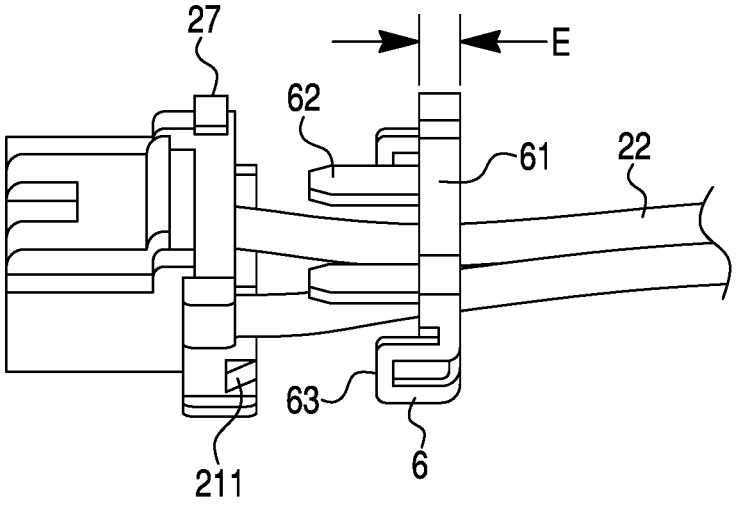
FIG. 14A is a side disassembled view of the moveable connector of FIG. 13.

FIG. 14A shows an embodiment as depicted in FIG. 10A of the moveable connector plug 2 in a partially disassembled state, with the retainer 6 pulled away from a rear surface of the connector 2 and exposing the entryway for the wires 22 into the moveable connector plug 2. Retainer 6 can include the top surface 61*a* of the upper lateral extending portion 61 and side lock structures 63 that can springingly engage with projections 211 (See FIG. 14A) on side surfaces of the connector 2 when assembled. Guide prongs 62 can be provided to project from the upper lateral extending portion 61 with its long sides along a surface of the retainer 6 facing the body positioning projections 27 of moveable connector plug 2 and can be inserted from the rear end of the connector body 21 of the moveable connector plug 2 into slideways located beneath the intermediate surface 27. The side lock structures 63 are each connected at upper rear end portions thereof to each lateral end of the upper lateral extending portion 61 (See FIG. 14C).

The moveable connector plug 2 can include an upper surface 24 which is flexible in an up-down direction and extends to form an upward slope to the rear end of the movable connector plug 2 (See FIG. 11). The upper surface 24 has a longitudinal length which is sufficient to push up from below and retain the receptacle positioning projection 33 of the receptacle 3 at its rear end portion, and does not extend to the rear end of the movable connector plug 2. In top view of the movable connector plug 2, the intermediate surface 28 is exposed (See FIG. 11). The intermediate surface 28 also forms part of upper contours of the terminal attachment sections 23. The upper surface 24 includes a body attachment projection 241 located just forward of the body positioning projections 27 and configured to engage with the receptacle positioning projection 33 of the fixed connector receptacle 3. Body positioning projections 27 can be provided to project from lateral rear ends of the intermediate surface 28 of the moveable connector plug 2, and can be configured to define a rear engagement aperture 29*a* with the intermediate surface 28 to facilitate attachment movements of the rear positioning tab 42 into the rear engagement aperture 29*a* and a secure connection therebetween.

Figure 14B:
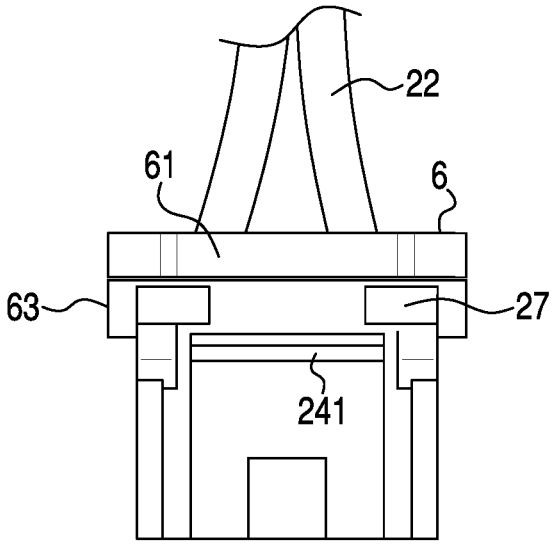
FIG. 14B is another top view of the moveable connector of FIG. 13.
Figure 14C:
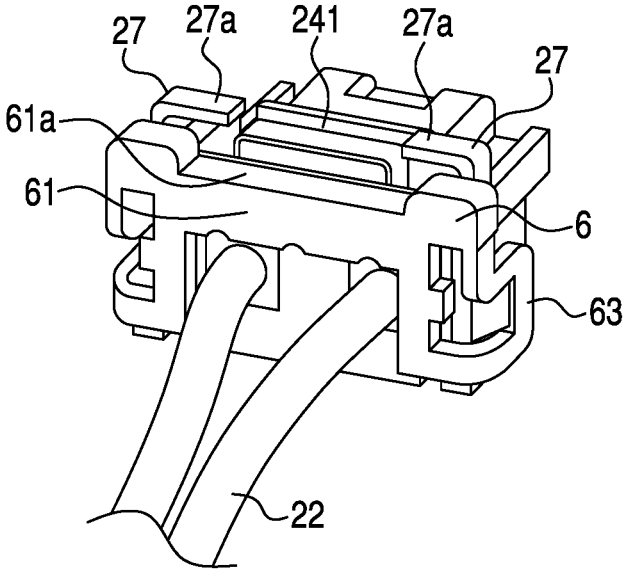
FIG. 14C is rear perspective view of the moveable connector of FIG. 13.

FIGS. 14B and 14C show the moveable connector plug 2 of FIG. 14A in a top and perspective view, respectively. In FIG. 14B, the rearmost edges of the top surfaces 27*a* of projections 27 are aligned with each other. The rearmost edge of the projections 27 abut the retainer 6, and directly contact the lateral ends of the upper lateral extending portion 61 so that the upper lateral extending portion 61 is located along a line passing through the rearmost edges of the body positioning projections 27.

Figure 15:
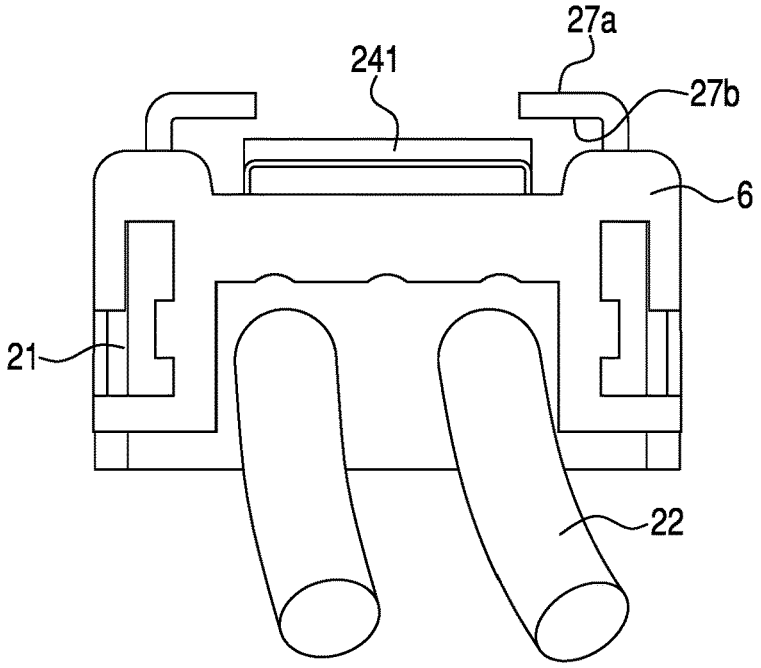
FIG. 15 is a rear view of the moveable connector of FIG. 13.

FIG. 15 shows a rear view of the moveable connector plug 2 of the embodiment shown in FIG. 10A (and FIG. 11), and includes the body attachment projection 241. During assembly, the rear positioning tab 42 will engage into the aperture 29*a* under the body positioning projections 27 in order to lock the lock cover 4 with respect to the pre-assembled moveable connector plug 2 and fixed connector receptacle 3. The body 21 of the moveable connector plug 2 is shown in this view with side lock structures 63 embracing the body 21 to firmly secure the retainer 6 to the connector 2.

Figure 16:
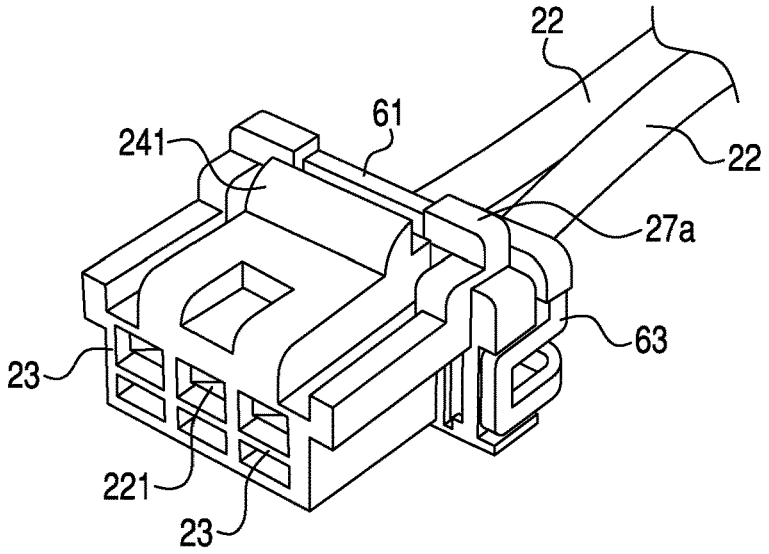
FIG. 16 is a front perspective view of the moveable connector of FIG. 13.

FIG. 16 is a front perspective view of the moveable connector plug 2 of the embodiment shown in FIG. 10A. Lead wires connectors 221 (connected to wires 22) are located within terminal attachment sections 23 for connection to contact pins 32 of the fixed connector receptacle 3. As shown in FIG. 11, the guide prongs 62 can also be located within the terminal attachment sections 23 for attachment of the retainer 6 to the connector body 21. Alternatively, separately from the terminal attachment sections 23, the movable connector body 21 may further include a corresponding number of guide prong sections (not shown) into which each guide prong 23 is slidably inserted from the rear end of the connector body 21. The guide prong sections are located under the intermediate surface 28 adjacent the terminal attachment sections 23. The body 21 of the moveable connector plug 2 is shown in this view with side lock structures 63 embracing the body 21 to firmly secure the retainer 6 to the connector 2. A side surface of the upper lateral extending position 61 of the retainer 6 is located facing the body attachment projection 241 of the connector plug 2.

Some exemplary operational advantages of the presently disclosed subject matter are described below. First, by appropriately determining the distance D, or the sum of D and E, only when the electrical connection between the contact pins and the contact portions is properly made, the lock cover 4 can be engaged to the rear engagement aperture 29, 29*a*.

Second, since the lock cover 4 securely fixes and retains the position of the movable connector plug 2 relative to the fixed connector receptacle 3, the possibility of accidental detachment caused by vibration of an automobile or other vehicle incorporating the lighting assembly is reduced. This can be achieved by the structure in the first embodiment as well as other embodiments of the invention. For example, the front positioning portion or tab 41 engages a positioning opening 34 of the fixed connector receptacle 3, and a rear positioning projection 42 of the lock cover 4 engages with the rear engagement aperture 29 by lifting the rear positioning tab 42 from below toward the body positioning projections 27 to contact and retain therewith by the roof 26. In the second embodiment, instead of the roof 26, the retainer 6 pushes the rear positioning tab 42 up from below toward the body positioning projections 27 to contact and retain therewith. Further, the lock cover 4 has the side surfaces 44 connecting the front surface having the front positioning portion 41 and the rear surface having the rear positioning tab 42. The side surfaces of the lock cover increase strength of the lock cover, which supplements resistance against mechanical impact due to vibration of the automobile or other vehicle incorporating the lighting assembly. Third, although the lock cover 4 is small, it is easy to handle for attachment. The attachment can be made by engaging the front positioning portion 41 in the positioning hole 34 and rotating the lock cover 4 around the front positioning portion 41 as a pivot along side surfaces 44 of the fixed connector receptacle 3. Fourth, the structure for the attachment is simple, and it is not required to use a separate rotation axis and a separate retainer for engagement of the lock cover as in conventional art. Since the number of components can be reduced, production cost can be reduced, and the size of the lighting assembly can be made small. Fifth, since there is no hooks or projections exposed on the top, front, rear, and side surfaces of the lock cover, there is low risk of accidental detachment of the lock cover caused by anything accidentally touching the hooks or projections. Sixth, the geometry of the lock cover 4 allows it to be easily molded, and also easily manipulated during use by either a human or robot. Seventh, the structures of the lock cover 4 that fit and lock with fixed connector receptacle 3 and connector plug 2 can be made with tolerances such that a clicking noise can heard when an appropriate fit is achieved. Further, testing of the proper locking between parts can be reduced or eliminated (for example, push pull tests after connection of structures can either be reduced or eliminated).

Alternative Embodiments

While certain embodiments of the invention are described above, and the drawings disclose a best mode for practicing the various inventive aspects, it should be understood that the invention can be embodied and configured in many different ways without departing from the spirit and scope of the invention.

For example, embodiments disclosed above include a single piece unitary lock cover 4. However, the lock cover 4 (as well as other components of the assembly) can be made from multiple parts that are connected by attachment structures, materials, or welds (or made in an integral one piece manner). The various structures can be made from any material suitable for a particular application of the assembly. For example, the component body parts can all be made from plastic, while the circuit structures such as wires, contact pins, and terminals, can be made from metal. However, other materials are contemplated, including ceramics, wood, semiconductive materials.

It should be noted that any of the male/female connective structures can be reversed in construction (female/male) without departing from the spirit and scope of the disclosed subject matter. Likewise, the various apertures can be made larger or can be deleted altogether depending on a particular application and/or desired method for constructing each of the component parts. The various plastic parts can be injection molded or formed in other various manners, including casting, blow molding, printing, etc. Exemplary embodiments are also intended to cover any number of electrical connections. The disclosed embodiments show two wires 22 and three contact pins 32. However, the number of wires 22 and contact pins 32 can be lower or higher depending on a particular application for the lighting assembly structure.

The method for attaching the lock cover 4 to the pre-assembled fixed connector receptacle 3 and moveable connector plug 2 is described as using the front positioning portion 41 as a pivot when located within the fixed connector receptacle 31 of the fixed connector. The lock cover 4 is then rotated and the rear positioning tab 42 snaps over the flexible roof portion 261*a* into location in aperture 29. However, the roof structure of roof 26 and receptacle 31 can be interchanged, and the method of connecting can take place from a rear pivot point. In other words, a frontward located roof structure with aperture can be located on the fixed connector receptacle 3, and a rearward located receptacle can be located in the moveable connector plug 2. In this case, the lock cover would pivot about a rearward location on the moveable connector over the pre-assembled fixed connector receptacle 3 and moveable connector plug 2, and snap over a flexible roof structure into an aperture located on the front surface of the fixed connector receptacle 3.

The positioning tab 42 is shown as having a top surface that extends at an approximate 45 degree angle with respect to the top surface and rear wall of the lock cover. However, this angle can vary considerably depending on the application and environment in which the lighting assembly is intended to be used. The thickness of the tab 42 can also vary. In particular, it might be beneficial to have the thickness of the tab 42 be the exact width of aperture 29, or be shaped such that the flexible roof portion 261*a* is constantly elastically deformed when the tab 42 is located within the aperture 29. In an alternate embodiment, the width and shape of the tab 42 can be selected to provide a small amount of tolerance or play while located in aperture 29 such that the lock cover 4 can move a predetermined amount with respect to the fixed connector receptacle 3.

While the subject matter has been described in detail with reference to exemplary embodiments thereof, it will be apparent to one skilled in the art that various changes can be made, and equivalents employed, without departing from the scope of the invention. All related art references discussed in the above Description of the Related Art section are hereby incorporated by reference in their entirety.

What is claimed is:

1. A vehicle lighting assembly, comprising:

a wiring board including wiring;

a fixed connector receptacle mounted on the wiring board, the fixed connector receptacle including,

[i] a plurality of terminals exposed from a front surface of the fixed connector receptacle, and connected to the wiring of the wiring board,

[ii] contact pins electrically connected to the plurality of terminals,

[iii] a positioning opening located on an outer front surface of the fixed connector receptacle;

a movable connector plug including,

[i] a connector body,

[ii] electrical wires extending from a rear end of the connector body including an insulating material,

[iii] a plurality of terminal attachment sections, and

[iv] a plurality of lead wires having contact portions at their front ends located in each of the terminal attachment sections, the lead wires electrically connected to the electrical wires inside the connector body,

[v] a roof projecting from a rear end portion of an upper surface of the movable connector plug, the roof including two posts and a roof flex portion connecting the two posts, and the roof flex portion configured to be flexible in an up-down direction,

[vi] body positioning projections projecting upward from lateral rear ends of the upper surface of the connector body, while the top surfaces of the body positioning projections are flush with a top surface of the fixed connector receptacle, and a front end of the top surfaces and a front end of the roof flex portion is on a same line; and a lock cover having a front surface, a rear surface, and side surfaces each connecting the front surface and the rear surface, and an upper surface, the lock cover including,

[i] a front positioning portion projecting from the front surface of the lock cover toward the rear surface of the lock cover,

[ii] a rear positioning tab projecting from a rear surface of the lock cover to the front surface of the lock cover, wherein when the movable connector plug is inserted into the fixed connector receptacle along an insertion direction, each of the contact pins is inserted into a corresponding terminal attachment section and makes electrical connection between respective contact portions and contact pins, wherein an upper surface of the roof flex portion is located inside of the body positioning projections, and the upper surface of the roof flex portion and the inner lower surface of the body positioning projections collectively define a rear engagement aperture, into which the rear positioning tab of the lock cover is engaged when in a fully assembled position, wherein the upper surface of the roof flex portion contacts a lower surface of the rear positioning tab with flexible force of the roof flex portion, thereby lifting the rear positioning tab from below toward the body positioning projections to contact and retain the positioning tab adjacent the body positioning projections, wherein a distance from an inner front surface to an inner rear surface of the lock cover is defined as distance A, a distance from the outer front surface of the fixed connector receptacle to a rear surface of the connector body when the rear surface of the connector body is in the fully assembled position is defined as distance B, and in the fully assembled position the connection between the contact pins and the contact portions is properly made in the plurality of terminal attachment sections, and distance A is equal to distance B, wherein the lock cover is configured to be rotatable around the front positioning portion of the lock cover engaged in the positioning opening as a pivot along the side surfaces of the fixed connector receptacle, until the rear positioning tab engages with the rear engagement aperture in the fully assembled position.

2. The lighting assembly of claim 1, wherein a distance from a front outer surface of the connector body to a front end of the roof is defined as distance C and corresponds to the distance from an inner front surface to a rear end of the fixed connector receptacle, wherein a distance from a rear end of the roof to the rear end of the fixed connector receptacle is distance D, wherein a retainer is located at a rear surface of the movable connector plug, and a length E from a front end to a rear end of an exposed portion of the retainer corresponds to a distance between a rear surface of the movable connector plug and an inner rear end surface of the lock cover when the rear surface of the connector body is in the fully assembled position, wherein the definition of the distance B is substituted by a distance from an outer front surface of the fixed connector receptacle to a rear surface of the retainer when the rear surface of the movable connector plug and the retainer are in the fully assembled position, and only when the sum of distance D and distance E is within a predetermined range, and the sum of distance C, distance D and distance E corresponds to distance B, can the rear positioning tab engage with the rear engagement aperture.

3. The lighting assembly of claim 1, wherein the lock cover further includes lateral front side positioning projections projecting from front ends of the side surfaces to a front surface of the lock cover.

4. The lighting assembly of claim 3, wherein the lateral front side positioning projections define an opening in the lock cover between the lateral front side projections and the front positioning portion such that front positioning portion is viewable from a location outside the lock cover during assembly of the positioning portion into the positioning opening of the connector receptacle.

5. The lighting assembly of claim 1, wherein the wiring board is a printed wiring board.

6. The lighting assembly of claim 1, wherein the wiring of the wiring board is connected to at least one of a vehicle headlamp, a vehicle turn signal lamp, a vehicle brake lamp, and a vehicle marker lamp.

7. The lighting assembly of claim 1, further comprising a receptacle positioning projection located on an inner upper surface of the fixed connector receptacle, and wherein an upper surface of the connector body includes a positioning recess receiving the receptacle positioning projection when in the fully assembled position.

8. The lighting assembly of claim 1, wherein the lock cover includes a rear lock aperture extending through adjoining portions of the upper surface and rear surface of the lock cover, and the positioning tab forms a lower border of the rear lock aperture such that positioning tab is viewable from a location outside of the lock cover to assist in alignment of the positioning tab with rear engagement aperture on the connector plug.

9. The lighting assembly of claim 1, wherein the positioning tab extends away from the upper surface of the lock cover and at an acute angle with respect to both the upper surface of the lock cover and the rear surface of the lock cover.

10. The lighting assembly of claim 1, wherein the positioning portion and positioning tab extends towards each other and in the final assembly position are connected to the connector plug and connector receptacle, respectively, to lock the connector plug adjacent the connector receptacle.

11. The lighting assembly of claim 1, wherein a distance from a front outer surface of the connector body to a front end of the roof is defined as distance C and corresponds to the distance from an inner front surface to a rear end of the fixed connector receptacle, wherein a distance from a rear end of the roof to the rear end of the fixed connector receptacle is distance D, wherein only when distance D is within a predetermined range, and the sum of distance C and distance D corresponds to distance B, can the rear positioning tab engage with the rear engagement aperture.

12. A vehicle lighting assembly, comprising:

a wiring board including wiring;

a fixed connector receptacle mounted on the wiring board, the fixed connector receptacle including,

[i] a plurality of terminals exposed from a front surface of the fixed connector receptacle, and connected to the wiring of the wiring board,

[ii] contact pins electrically connected to the plurality of terminals,

[iii] a positioning opening located on an outer front surface of the fixed connector receptacle;

[iv] a receptacle positioning projection located on an inner upper surface of the fixed connector receptacle;

a movable connector plug configured for insertion into the fixed connector receptacle, the connector plug including,

[i] a connector body having an upper surface configured as an upward slope extending to a rear end of the connector body, and a positioning projection engaging with the receptacle positioning projection when in a fully assembled position,

[ii] electrical wires extending from a rear end of the connector body,

[iii] a plurality of terminal attachment sections, and

[iv] a plurality of lead wires having contact portions at their front ends located in each of the terminal attachment sections, the lead wires electrically connected to the electrical wires,

[v] an intermediate surface located under the upper surface and exposed at lateral rear ends of the connector body, a front end portion of the intermediate surface is connected to a front end of the upper surface;

[vi] body positioning projections projecting upward from lateral rear ends of the intermediate surface of the connector body, while outer top surfaces of the body positioning projections are flush with an outer top surface of the fixed connector receptacle;

a retainer located in contact with a rear surface of the connector body, having an upper lateral extending portion;

a rear engagement aperture defined by inner top surfaces of the body positioning projections and the intermediate surface of the connector plug; and a lock cover having a front surface, a rear surface, and side surfaces each connecting the front surface and the rear surface, and an upper surface, the lock cover including,

[i] a front positioning portion projecting from the front surface of the lock cover toward the rear surface of the lock cover,

[ii] a rear positioning tab projecting from a rear surface of the lock cover to the front surface of the lock cover, wherein when the movable connector plug is inserted into the fixed connector receptacle along an insertion direction, each of the contact pins is inserted into a corresponding terminal attachment section and makes electrical connection between respective contact portions and contact pins, wherein the rear positioning tab of the lock cover is configured to engage in the rear engagement aperture when in a fully assembled position, wherein a lower surface of the rear positioning tab contacts a top surface of the upper lateral extending portion of the retainer, thereby lifting the rear positioning tab from below upward to contact and retain the positioning tab adjacent the body positioning projections, wherein the lock cover is configured to be rotatable around the front positioning portion of the lock cover engaged in the positioning opening as a pivot along the side surfaces of the fixed connector receptacle, until the rear positioning tab engages with the rear engagement aperture in the fully assembled position.

13. The lighting assembly of claim 12, wherein the lock cover further includes lateral front side positioning projections projecting from front ends of the side surfaces to a front surface of the lock cover.

14. The lighting assembly of claim 13, wherein the lateral front side positioning projections define an opening in the lock cover between the lateral front side projections and the front positioning portion such that front positioning portion is viewable from a location outside the lock cover during assembly of the positioning portion into the positioning opening of the connector receptacle.

15. The lighting assembly of claim 12, wherein the upper surface of the connector body includes a positioning recess receiving a receptacle positioning projection located in the connector receptacle when in the fully assembled position.

16. The lighting assembly of claim 12, wherein the lock cover includes a rear lock aperture extending through adjoining portions of the upper surface and rear surface of the lock cover, and the positioning tab forms a lower border of the rear lock aperture such that positioning tab is viewable from a location outside of the lock cover in alignment of the positioning tab with rear engagement aperture.

17. The lighting assembly of claim 12, wherein the positioning tab extends away from the upper surface of the lock cover and at an acute angle with respect to both the upper surface of the lock cover and the rear surface of the lock cover.

18. The lighting assembly of claim 12, wherein the outermost perimeter area of the lock cover consists of four planar surfaces when in the fully assembled position such that there are no projections extending from the lock cover.

19. The lighting assembly of claim 12, wherein the front positioning portion and the rear positioning tab extend towards each other and in the final assembly position are connected to the connector plug with the retainer and the connector receptacle, respectively, to lock the connector plug with the retainer adjacent the connector receptacle.

20. The lighting assembly of claim 12, wherein a distance from an inner front surface to an inner rear surface of the lock cover is defined as distance A, a distance from an outer front surface of the fixed connector receptacle to the rear surface of the connector body when the rear surface of the connector body is in the fully assembled position is defined as distance B, and in the fully assembled position the connection between the contact pins and the contact portions is properly made in the plurality of terminal attachment sections, and distance A is equal to distance B plus E, a distance from a front outer surface of the connector body to a front end of the body positioning projection is defined as distance C and corresponds to the distance from an inner front surface to a rear end of the fixed connector receptacle, a distance from a rear end of the body positioning projections to the rear end of the fixed connector receptacle is distance D, a distance from a front to rear end of the top surface of the retainer is distance E, and only when sum of the distance D and distance E is within a predetermined range, and the sum of the distance C, distance D and distance E corresponds to distance B plus E, can the rear positioning tab engage with the rear engagement aperture.

21. A method of manufacturing the assembly of claim 12, comprising:

inserting the movable connector plug into the fixed connector receptacle;

contacting the front positioning portion of the lock cover with the positioning opening of the fixed connector receptacle; and rotating the lock cover relative to the movable connector plug until the rear positioning tab engages with the rear engagement aperture.

22. The lighting assembly of claim 12, wherein the wiring of the wiring board is connected to at least one of a vehicle headlamp, a vehicle turn signal lamp, a vehicle brake lamp, and a vehicle marker lamp.

* * * * *